US008074978B2

(12) United States Patent
Takahashi

(10) Patent No.: US 8,074,978 B2
(45) Date of Patent: Dec. 13, 2011

(54) SHEET FEEDING DEVICE AND IMAGE-FORMING APPARATUS

(75) Inventor: Takayuki Takahashi, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 293 days.

(21) Appl. No.: 12/403,753

(22) Filed: Mar. 13, 2009

(65) Prior Publication Data

US 2009/0283958 A1 Nov. 19, 2009

(30) Foreign Application Priority Data

May 15, 2008 (JP) ..... 2008-128907

(51) Int. Cl.
*B65H 3/14* (2006.01)

(52) U.S. Cl. ..... 271/97; 271/98

(58) Field of Classification Search ..... 271/11–13, 271/90, 94, 96, 276
See application file for complete search history.

(56) References Cited

U.S. PATENT DOCUMENTS

| | | | | |
|---|---|---|---|---|
| 5,110,110 | A * | 5/1992 | Wirz et al. | 271/98 |
| 6,082,728 | A * | 7/2000 | Ubayashi | 271/108 |
| 7,140,605 | B2 * | 11/2006 | Suga et al. | 271/97 |
| 7,775,520 | B2 * | 8/2010 | Matsudaira et al. | 271/284 |

FOREIGN PATENT DOCUMENTS

| | | | |
|---|---|---|---|
| EP | 1840057 | * | 10/2007 |
| JP | 6-227692 | * | 8/1994 |
| JP | 2001-192133 | * | 7/2001 |
| JP | 2005-162456 | | 6/2005 |
| JP | 2007-31070 | | 2/2007 |
| JP | 2007-197097 | | 8/2007 |

* cited by examiner

*Primary Examiner* — Stefanos Karmis
*Assistant Examiner* — Thomas Morrison
(74) *Attorney, Agent, or Firm* — Oblon, Spivak, McClelland, Maier & Neustadt, L.L.P.

(57) ABSTRACT

An image-forming apparatus and sheet feeding device capable of feeding sheets without skewing or multi-feeding of sheets using a small number of side air blowing drive sources. The sheet feeding device has a plurality of side discharge nozzles comprising side discharge outlets for blowing air onto the respective side edge surfaces of a paper stack, and two sirocco fans which are communicatively connected in series as a side air blowing drive source, and are communicatively connected, via a side discharge drive source chamber and a side discharge relay tube (duct), to the plurality of side discharge nozzles. The respective side discharge nozzles capable of moving in linkage with side fences, and an immovable fixed side discharge nozzle are disposed at different distances from the leading edge of the loaded and set paper stack with respect to a sheet feeding direction.

18 Claims, 16 Drawing Sheets

OPTIMUM SIDE AIR BLOWING STATE FOR EACH PAPER TYPE

SHEET FEEDING DEVICE AND IMAGE-FORMING APPARATUS

BACKGROUND OF THE INVENTION

1. Field of the Invention

The present invention relates to a sheet feeding device and an image-forming apparatus having same, and more particularly, to an air suctioning-type sheet feeding device which separates sheets from a stack of sheets by blowing air, and feeds the uppermost one sheet that has been separated while air suctioning the sheet, and an image-forming apparatus having the sheet feeding device, such as a printing apparatus including a stencil printing apparatus, a copying apparatus including an electrophotographic copier, a facsimile apparatus, a printer, an inkjet recording apparatus, a plotter or a compound apparatus comprising these plurality of functions.

2. Description of the Related Art

As is widely known, a sheet feeding device (a paper feeding device) for extracting and feeding sheets one at a time from a sheet stack can be a friction type or an air type. In particular, the air-type paper feeding device is for separating sheets from a stack of sheets by blowing/discharging air, and feeding the uppermost one sheet that has been separated while air suctioning the sheet, and for example, the air-type paper feeding devices disclosed in Japanese Patent Laid-open Publication No. 2005-162456 (hereinafter referred to as Prior Art 1), Japanese Patent Laid-open Publication No. 2007-31070 (hereinafter referred to as Prior Art 2), and Japanese Patent Laid-open Publication No. 2007-197097 (hereinafter referred to as Prior Art 3), are known.

In the air-type paper feeding device of the prior art, front air is blown from the front of the paper stack onto the leading edge surface (front edge surface) of the paper stack. Further, side air is also blown onto both side edge surfaces of the paper stack in the same manner. Blowing the respective air onto the leading edge surface and both side edge surfaces of the paper stack like this separates the papers of the upper portion of the paper stack one sheet at a time.

Now then, the prior art side air blowing system includes a system for blowing side air from only one side with respect to the sheet width direction, and a system for blowing side air from both sides with respect to the sheet width direction.

However, these two prior art side air blowing systems suffer from the following problems. That is, first, when using paper (sheets) that are large with respect to the sheet width direction in the side air blowing system that only blows air from the side fence of the one side, for example, in the case of an A3 or A4 width-wise sheet (in other words, a size of 297 mm with respect to the sheet width direction), only one side of the sheet with respect to the sheet width direction lifts and separates; the other side does not lift. If a piece of paper is suctioned onto the suctioning belt in this state, the floating side can be held by suction and conveyed at a low load, but the non-floating side exhibits high conveying resistance, and is conveyed diagonally, that is, results in skewed conveying. In a worst case scenario, the paper is unable to be reliably suctioned and mis-feeding occurs.

Second, in the case of a side blowing system that blows air from both side fences, trouble like that described in the first case above does not occur when using paper that is large with respect to the sheet width direction (A3, and the like), and the lifting, separating and conveying of the paper is stable. However, by contrast, when using paper that is narrow with respect to the sheet width direction, for example, in the case of A5 and narrower paper (a size of 150 mm or less with respect to the sheet width direction), because the air is blown out from side air outlets disposed in the side fences of both sides, the streams of air collide with one another, and the air escapes either toward the front (with respect to the sheet feed direction) or toward the rear. If the air only escapes toward the rear, this is not particularly problematic, but the air also escapes toward the front. The air that escapes toward the front in this case affects the leading-edge part of the loaded paper, causing the paper to move forward on its own. That is, the problem of multi-feed conveying occurs.

As a measure for solving the second problem described above, stopping the side air blowing from the one side when using paper that is narrow with respect to the sheet width direction makes it impossible for the streams of air blowing out from both side fences to collide, and since there are side fences, the air is unable to escape completely.

Further, when this measure is implemented, a side air blowing drive source (DC fan or the like) must be mounted to each side fence, or a stopcock (switching valve) and a drive source (motor or the like) for opening and closing the stopcock is required, thereby driving up costs. It also becomes necessary to exercise control in accordance with the type of paper.

SUMMARY OF THE INVENTION

The present invention has been devised with the foregoing problems and situation in mind, and it is an object of the present invention to realize and provide a sheet feeding device with an air-type paper feeding system that makes it possible to carry out feeding with a small number of side air blowing drive sources without causing the skewed feeding or multi-feeding of sheets.

In an aspect of the present invention, a sheet feeding apparatus comprises an air-type separating device for separating a sheet one at a time by blowing air on both side edge surfaces of a loaded sheet stack; an air suctioning device for suctioning an uppermost separated sheet; and a sheet feeding device feeding the sheet held by suction by the air suctioning device in a sheet feeding direction. The air-type separating device has a plurality of side air outlets via which air is blown onto the respective side edge surfaces of the sheet stack, and a side air blowing drive source which is communicatively connected to the plurality of side air outlets. The plurality of side air outlets are disposed in at least two locations opposite the respective side edge surfaces of the sheet stack, and the side air outlets are disposed at different distances from the leading edge of the sheet stack with respect to the sheet feeding direction.

In another aspect of the present invention, an image-forming apparatus comprises a sheet feeding device and an image forming device for forming an image on a fed sheet. The sheet feeding apparatus comprises an air-type separating device for separating a sheet one at a time by blowing air on both side edge surfaces of a loaded sheet stack; an air suctioning device for suctioning an uppermost separated sheet; and a sheet feeding device for feeding the sheet held by suction by the air suctioning device in a sheet feeding direction. The air-type separating device has a plurality of side air outlets via which air is blown onto the respective side edge surfaces of the sheet stack, and a side air blowing drive source which is communicatively connected to the plurality of side air outlets. The plurality of side air outlets are disposed in at least two locations opposite the respective side edge surfaces of the sheet stack, and the side air outlets are disposed at different distances from the leading edge of the sheet stack with respect to the sheet feeding direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(S)

Figure 1:
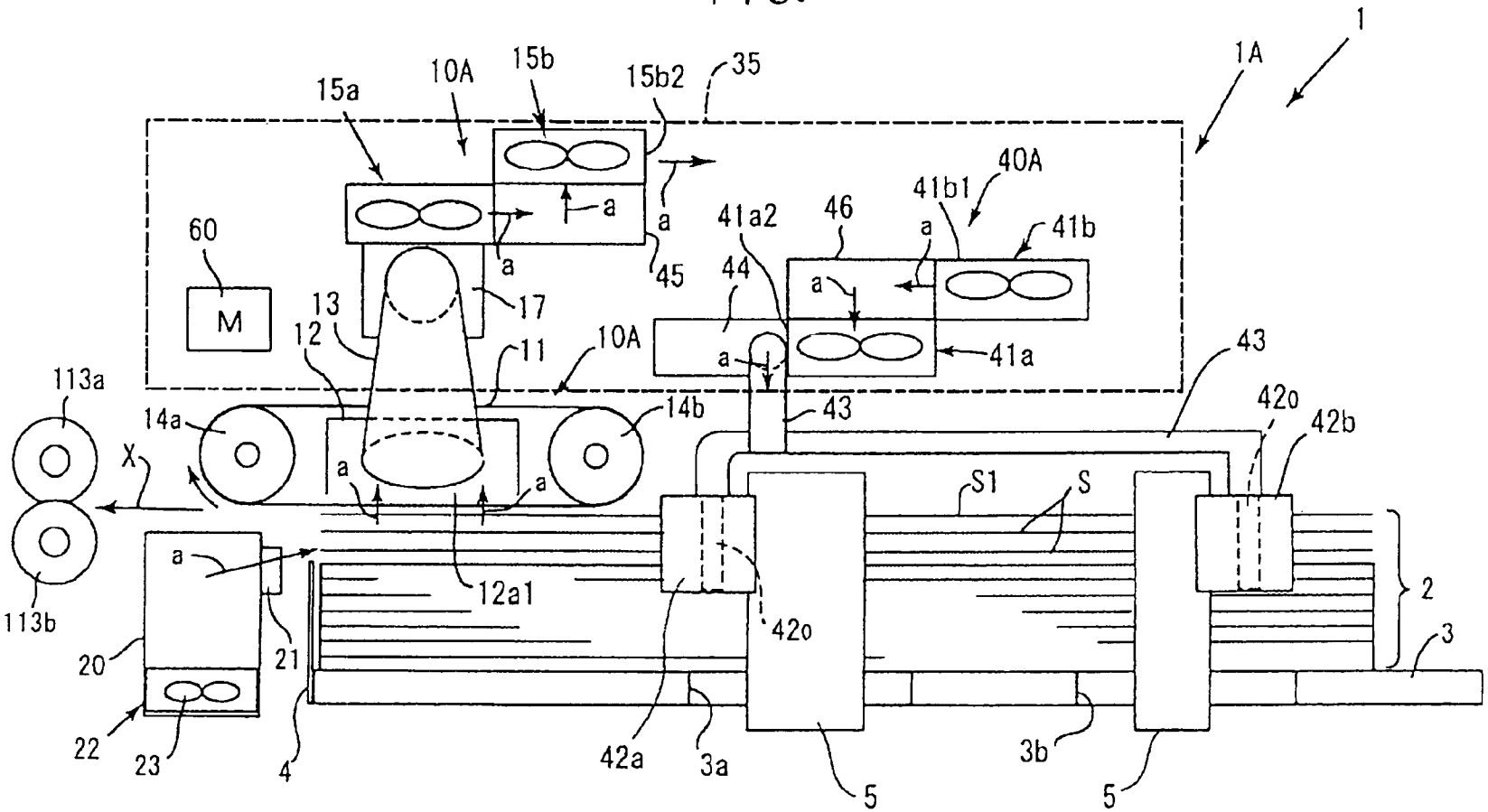
FIG. 1 is a partial schematic front view showing a paper feeding unit of an air-type paper feeding device of a first embodiment of the present invention.

The preferred embodiment for working the present invention will be explained hereinbelow by referring to the drawings. Members, constituent parts and other such components having the same functions for all of the above-described examples of the prior art, the embodiment and the modifications will be explained one time as much as possible in accordance with assigning the same reference numerals, and thereafter such explanations will be omitted. To make the diagrams and explanations concise, an explanation of a component that is represented in a diagram may be omitted without prior notice if an explanation of this diagram is not particularly needed. In a case where a component of a Japanese Patent Laid-open Publication or the like is cited and explained as-is, the reference numeral will be shown in parentheses to distinguish this component from the embodiment.

First, the prior art of the present invention and the problems associated therewith will be explained by referring to the diagrams.

Figure 15:
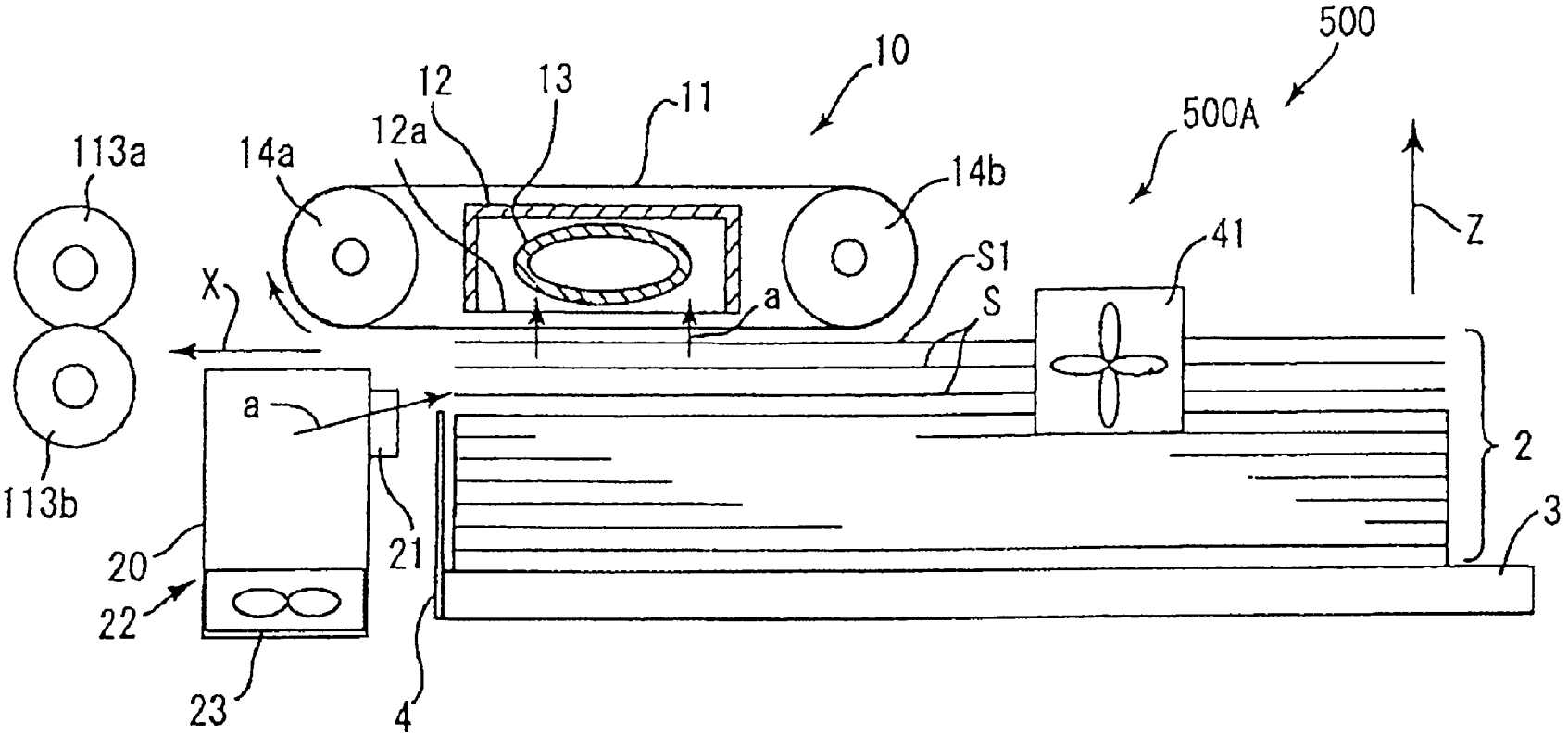
FIG. 15 PRIOR ART
FIG. 15 is a partial cross-sectional front view showing the essential part of air-type paper feeding device of the prior art.
Figure 16:
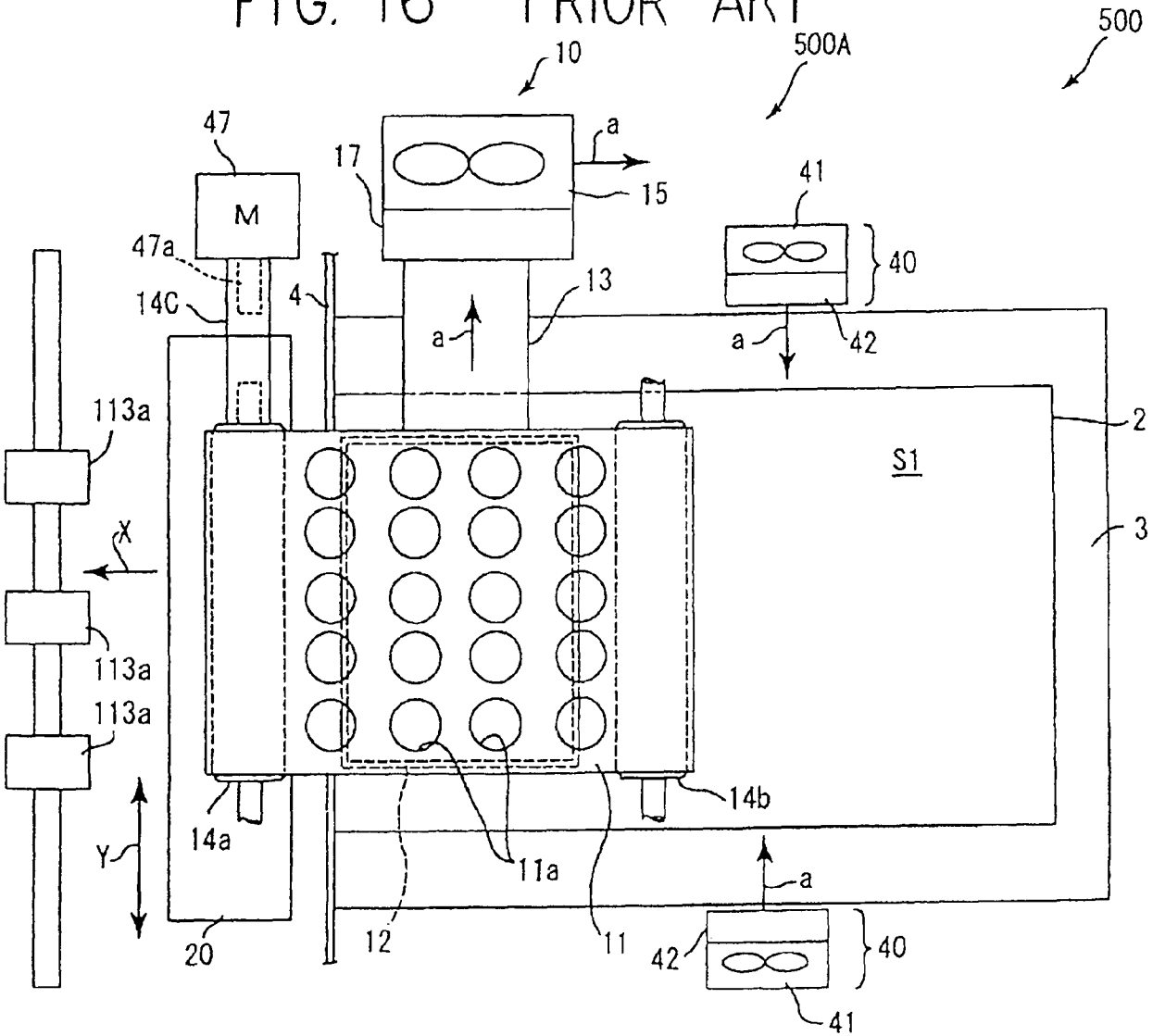
FIG. 16 PRIOR ART
FIG. 16 is a plan view of FIG. 15.

FIGS. 15 and 16 show an example of a conventional air-type paper feeding device 500 (will also be referred to as "air-type paper feeding device 500" hereinafter). The principle behind air-type paper feeding device 500 is carried out via the processes and operations outlined below in (1) through (3).

(1) Blowing air a onto the leading edge surface and both side edge surfaces of a paper stack 2 causes the air to enter in between the sheets of paper, thereby separating the sheets of paper S of the paper stack 2 one at a time as shown in FIG. 15.

(2) Suctioning only the uppermost one sheet of paper S1 of the separated sheets of paper S1, S allows the sheet of paper S1 to adhere to and be held by the suctioning belt 11.

(3) The one sheet of paper S1 is fed and conveyed by the rotation and traveling of the suctioning belt 11.

The operation of the constituent part (component) that functions in the process (1) for blowing the air a onto the leading edge surface and both side edge surfaces of the paper stack 2 is as follows. As shown in FIG. 15, a stream of air a is created from the front of the paper stack 2 by a front air discharge fan 23 comprising a DC fan as the front air discharge drive source, this air a passes through a front discharge chamber 20, exits to the outside from a front air outlet 21 and is blown onto the leading edge surface (front edge surface) of the paper stack 2. The front discharge chamber 20 and front air discharge fan 23, which comprise the front air outlet 21 here, configure a front discharge unit 22.

Further, as shown in FIGS. 15 and 16, streams of air a (also referred to as "side air" hereinafter) are similarly created from both the right and left side edge surfaces of the paper stack 2 by a right-left pair of side air discharge fans 41 comprising DC fans as the side air discharge drive sources, this air a passes through side discharge chambers 42, exits to the outside and is blown onto the respective side edge surfaces of the paper stack 2. Blowing the above-mentioned respective air on the leading edge surface and both side edge surfaces of the paper stack 2 causes the upper portion of the paper stack 2 to separate one sheet at a time as shown in FIG. 15.

The side air discharge fan 41 and side discharge chamber 42 here configure a side discharge unit 40. The front discharge unit 22 and the side discharge unit 40 configure air separating means for separating the papers S one sheet at a time by blowing air on the leading edge surface and both side edge surfaces of the paper stack 2 loaded onto the paper feeding tray 3.

The paper feeding tray 3 is elevatably configured to load the paper stack 2 in accordance with an up-down mechanism comprising a not-shown up-down motor as driving means. An upper limit detection sensor (not shown in the drawing, but, for example, configured to turn ON/OFF a transmission-type photosensor using a roller-shaped member and a filler that disposes this member in a rotatably supported bracket)

arranged above the paper feeding tray 3 to make sure that the uppermost papers S of the paper stack 2 loaded into the paper feeding tray 3 are touching the rear end part, and occupy the paper feeding position that enables the separated uppermost one sheet of paper S1 to undergo air-suction feeding. On the basis of a signal from this not-shown upper limit detection sensor, not-shown controlling means controls the above-mentioned not-shown up-down motor such that the paper feeding tray 3 maintains the proper height with respect to the height of the loaded paper stack 2.

A not-shown pair of side fences are movably disposed with respect to the sheet width direction to position the paper stack 2 by regulating the location of both side edges of the paper stack 2 in the paper feeding tray 3 with respect to the sheet feeding direction or the sheet conveying direction (hereinafter, also referred to as either the "paper conveying direction" or the "paper feeding direction") X and the sheet width direction (hereinafter also referred to as the "paper width direction") Y that is orthogonal thereto. Openings that allow the side air to pass through are formed in the respective side fences.

The constituent parts (components), which function in process (2) for suctioning only the one uppermost sheet of paper S1 that has been separated, and in process (3) for the suctioning belt 11 to convey the one sheet of paper S1 by rotating and traveling, are the suctioning belt 11, drive roller 14*a*, slave roller 14*b*, suctioning chamber 12, suctioning relay tube (duct) 13, air suctioning drive fan 15, suctioning drive source chamber 17, and suctioning belt drive motor 47.

The suctioning belt 11, which comprises an endless belt suspended between a drive roller 14*a* and a slave roller 14*b* that serve as a pair of rotating members, is located above the uppermost sheet of paper S1 in the paper stack 2, and a large number of holes 11*a* are formed in the suctioning belt 11 for air suction. Furthermore, in FIG. 16, to make the drawing concise, the hole 11*a* formation locations have been drawn so as to be formed within a specific range on the suctioning belt 11 between the drive roller 14*a* and the slave roller 14*b*, but, of course, the holes 11*a* span the entire sheet feeding direction X and sheet width direction Y orthogonal thereto on the suctioning belt 11, and, naturally, are formed at an equal pitch on the underside of the suctioning belt 11 and above the respective rollers 14*a*, 14*b* as well (the same also holds true for the plan view of the suctioning belt 11, which will be explained hereinbelow).

A not-shown pair of unit side plates configuring a paper feeding unit 500 (configured from practically all the constituent parts that function in the above-mentioned processes (1) through (3), to include this paper feeding tray 3), which will be explained hereinbelow, are disposed on the left and right outer sides of the paper feeding tray 3 in which the paper stack 2 is loaded, and the drive roller 14*a* and slave roller 14*b* are rotatably supported pivotally by the above-mentioned pair of unit side plates in the direction of the arrow in FIG. 15 (the clockwise direction). Further, in an air-type paper feeding device that does not configure a paper feeding unit, the drive roller 14*a* and the slave roller 14*b* are rotatably supported pivotally by a not-shown pair of side plates by the above-mentioned pair of unit side plates, which are fastened to the main unit of the device, in the direction of the arrow in FIG. 15 (the clockwise direction).

One end of the shaft of the drive roller 14*a* is connected via a coupling 14*c* to an output shaft 47*a* of the suctioning belt drive motor 47 that serves as belt driving means, which is securely fastened to the above-mentioned the one of the unit side plates. The suctioning belt drive motor 47, for example, comprises a stepping motor that easily and accurately exercises variable speed control and rotation-based control in accordance with the conveying distance.

A substantially box-shaped suctioning chamber 12 for suctioning air a, in which a downward-facing aperture 12*a* is formed, is disposed between the drive roller 14*a* and the slave roller 14*b* in a space that is enclosed on the top and bottom by the suctioning belt 11. The suctioning relay tube 13 is communicatively connected to one side of the suctioning chamber 12 via a suctioning aperture 13*a* shown in FIG. 16.

The drive source for performing air suctioning is an air-suction drive fan 15 that serves as the air suctioning drive source, and a suctioning drive source chamber 17 is communicatively connected to this air-suction drive fan 15. Therefore, the suctioning chamber 12 and the air-suction drive fan 15 are communicatively connected via the suctioning relay tube (duct) 13 and the suctioning drive source chamber 17.

The above-mentioned suctioning belt 11, drive roller 14*a*, slave roller 14*b*, suctioning chamber 12, suctioning relay tube 13, air-suction drive fan 15, suctioning drive source chamber 17, and suctioning belt drive motor 47 configure a suctioning unit 10.

The suctioning belt 11, suctioning chamber 12, suctioning relay tube 13, air-suction drive fan 15, and suctioning drive source chamber 17 configure air suctioning means in the above-mentioned suctioning unit 10.

Further, in the above-mentioned suctioning unit 10, the suctioning belt 11, drive roller 14*a*, slave roller 14*b*, and suctioning belt drive motor 47 configure sheet feeding means for feeding a sheet of paper S held by suction by the above-mentioned air suctioning means.

The operations in the above-mentioned processes (2) and (3) are as follows. That is, when air a is suctioned by the suctioning chamber 12 via the suctioning drive source chamber 17 and suctioning relay tube 13 in accordance with operating the air-suction drive fan 15, the inside of the suctioning chamber 12 transitions to negative pressure and air a is suctioned via the suctioning belt 11 holes 11*a* in a range opposite the aperture 12*a* of the suctioning chamber 12, thereby causing the uppermost one sheet of paper S1 separated in the above-mentioned process (1) to adhere and be held by suction to the suctioning belt 11.

When the sheet of paper S1 adheres to the suctioning belt 11, the driving of the suctioning belt drive motor 47 causes the drive roller 14*a* to rotate in the direction of the arrow in FIG. 15 and the suctioning belt 11 to travel, thereby conveying the sheet of paper S1 to an upper-and-lower pair of resist rollers 113*a*, 113*b* disposed on the downstream side with respect to the sheet feeding direction X. Stopping the driving of the suctioning belt 11 drive motor 47 subsequent to conveying the sheet of paper S1 to the resist rollers 113*a*, 113*b* causes the suctioning belt to stop travelling, and the suctioning operation waits for a predetermined time period. The conveying of the remainder of the sheet of paper S1 is carried out by rotating the resist rollers 113*a*, 113*b*. When the end of the sheet of paper S1 reaches the vicinity of a front surface plate 4, which abuts the leading edge surface of the paper stack 2, the next sheet of separated paper S adheres to the suctioning belt 11 in accordance with the same operations as above. An air-type paper feeding system feeds paper by repeating these processes/operations. Furthermore, a plurality of not-shown vertical slits are made in the front surface plate 4 for allowing the air a blowing from the front air outlet 21 to pass through.

In FIGS. 15 and 16, 500A indicates the integrally configured paper feeding unit of the constituent parts configuring the air-type paper feeding device 500, with the exception of the resist rollers 113*a*, 113*b*. The paper feeding unit 500A, for example, is configured to be freely detachable by way of detaching means including a not-shown screw or other such tightening means from the device main unit 50 of the stencil printing device shown in FIG. 19, which will be explained hereinbelow.

The suction force of the air is determined by the total surface area of the suctioning belt 11 holes 11*a* located in a range opposite the aperture 12*a* of the suctioning chamber 12 (called the "surface area of the suctioning belt holes" hereinafter) and the velocity of the air suctioned through these holes 11*a*. To make the air suction force greater, generally speaking, the above-mentioned surface area of the suctioning belt holes may be increased, and the air velocity speeded up. This is because increasing the air suctioning force improves the operation for suctioning and holding a sheet of paper S. Furthermore, as used here, the suctioning force of the air signifies the volume and capacity of the air per unit of time.

To speed up the velocity of the air suctioned through the holes 11*a* of the suctioning belt 11, a suctioning relay tube 13 with a cross-section that is larger than the above-mentioned total surface area of the holes 11*a* of the suctioning belt 11 may be used.

Figure 2:
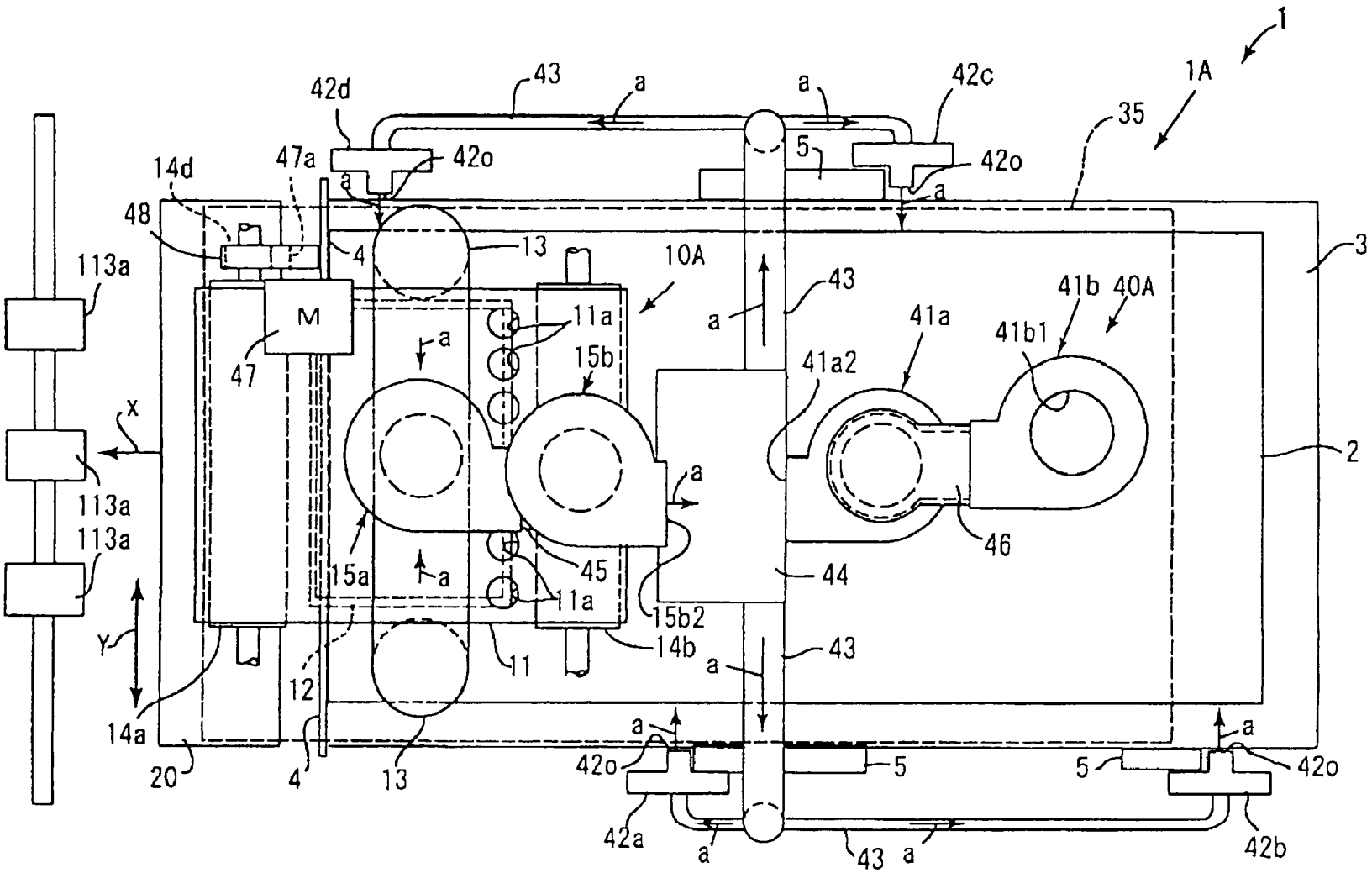
FIG. 2 is a plan view of FIG. 1.
Figure 3:
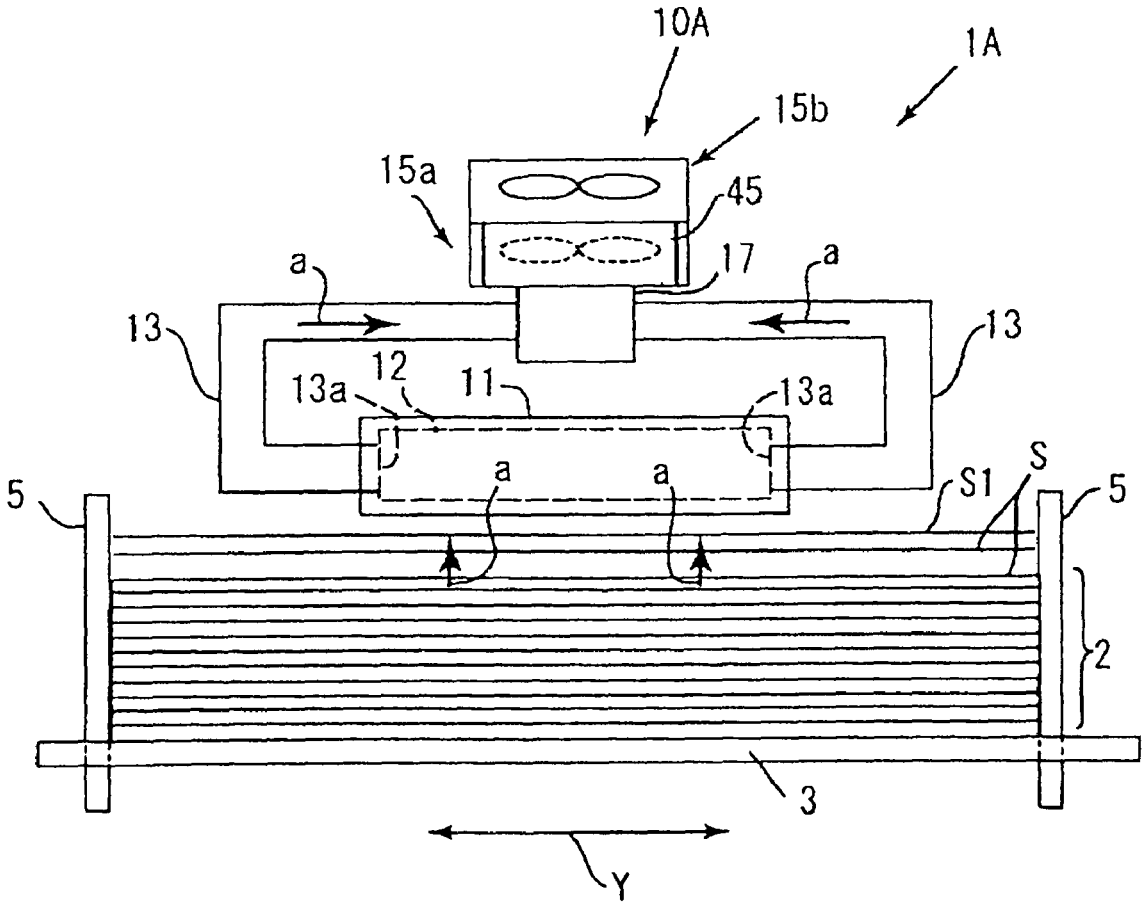
FIG. 3 is a partial schematic side view of the periphery of a suctioning unit of FIG. 1.

The side air blowing of the prior art lifts and separates a sheet of paper using a system in which side air blowing is carried out from only one side with respect to the sheet width direction as shown in FIGS. 2 and 3 of Prior Art 3 as described above, and by carrying out side air blowing through side regulating members (104, 104) (side fences) on both sides with respect to the sheet width direction as shown in FIG. 10 thereof.

The fans (4, 5) (side air blowing drive sources) shown in these FIGS. 2 and 3 are configured so as to link to the side regulating plate (2) and move with respect to the sheet width direction in accordance with the sheet size despite being installed in the side regulating plate (2) (side fence) of the one side.

Figure 6:
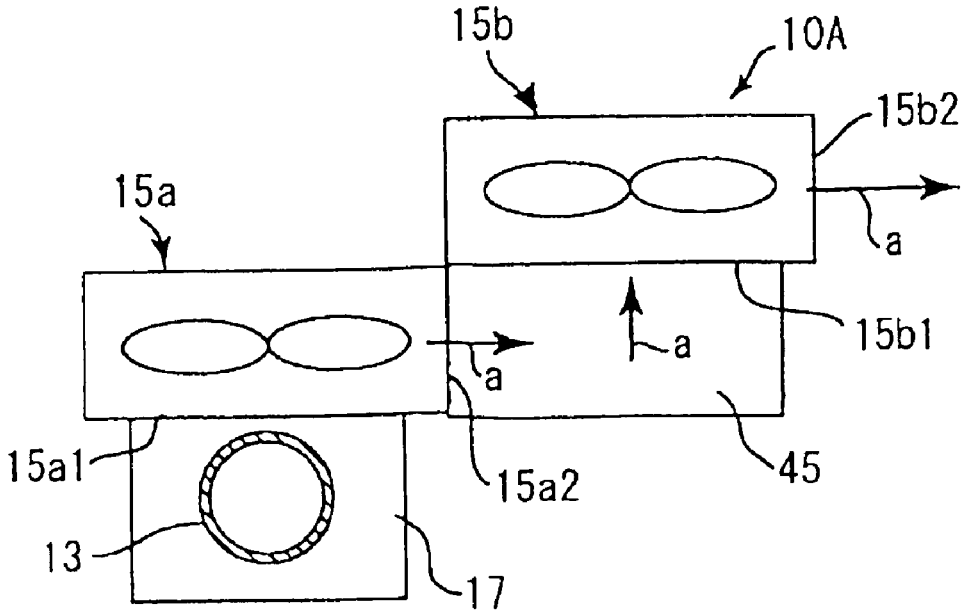
FIG. 6 is a schematic front view showing the essential part (the communicatively connected state of two sirocco fans) of the suctioning unit of FIG. 1.

However, in most prior art technologies, for example, the one side fence is fixed, and the aperture part (8*a*) of side air blowing means (side air outlet) is installed in this fixed side fence like the reference plate (4) (side fence) shown in FIG. 6 of Prior Art 2.

The blowing force of the air a (referred to as "side air a" hereinafter) relative to both the right and left side edge surfaces of the paper stack 2 is important for separating the sheets of paper S of the paper stack 2 one at a time in the paper separating process of the above-mentioned (1). The blowing force F of the side air a is determined by the blowing surface area (cross-sectional area) Ac and the air velocity (wind speed) V. However, in the following equation, Q is the volume of flow of the side air a, and ρ is the side air a density. That is, $F=Q\times V\times\rho=Ac\times V\times V\times\rho$ ($\therefore Q=Ac\times V$).

However, the above-mentioned two prior art side air blowing systems suffer from problems that need to be solved as was already explained.

The present invention, which solves for the problems of the above-mentioned prior art technologies, will be explained in detail below by referring to the drawings.

Figure 18:
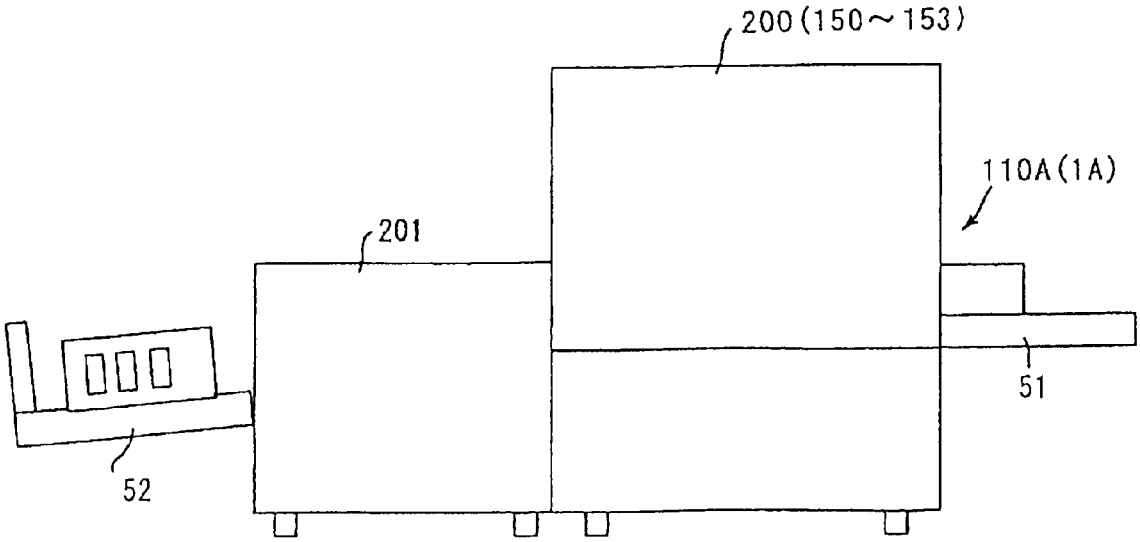
FIG. 18 is a simplified front view showing the overall configuration of a stencil printing apparatus that applies the present invention.

First, the overall configuration of a digital thermal stencil printing apparatus will be explained by referring to FIGS. 18 and 19 as one example of a printing apparatus that applies the present invention. FIG. 18 schematically shows the overall configuration of the above-mentioned digital thermal stencil printing apparatus, and FIG. 19 shows the overall configuration of primarily the stencil printing apparatus main unit 200 in FIG. 18.

Figure 19:
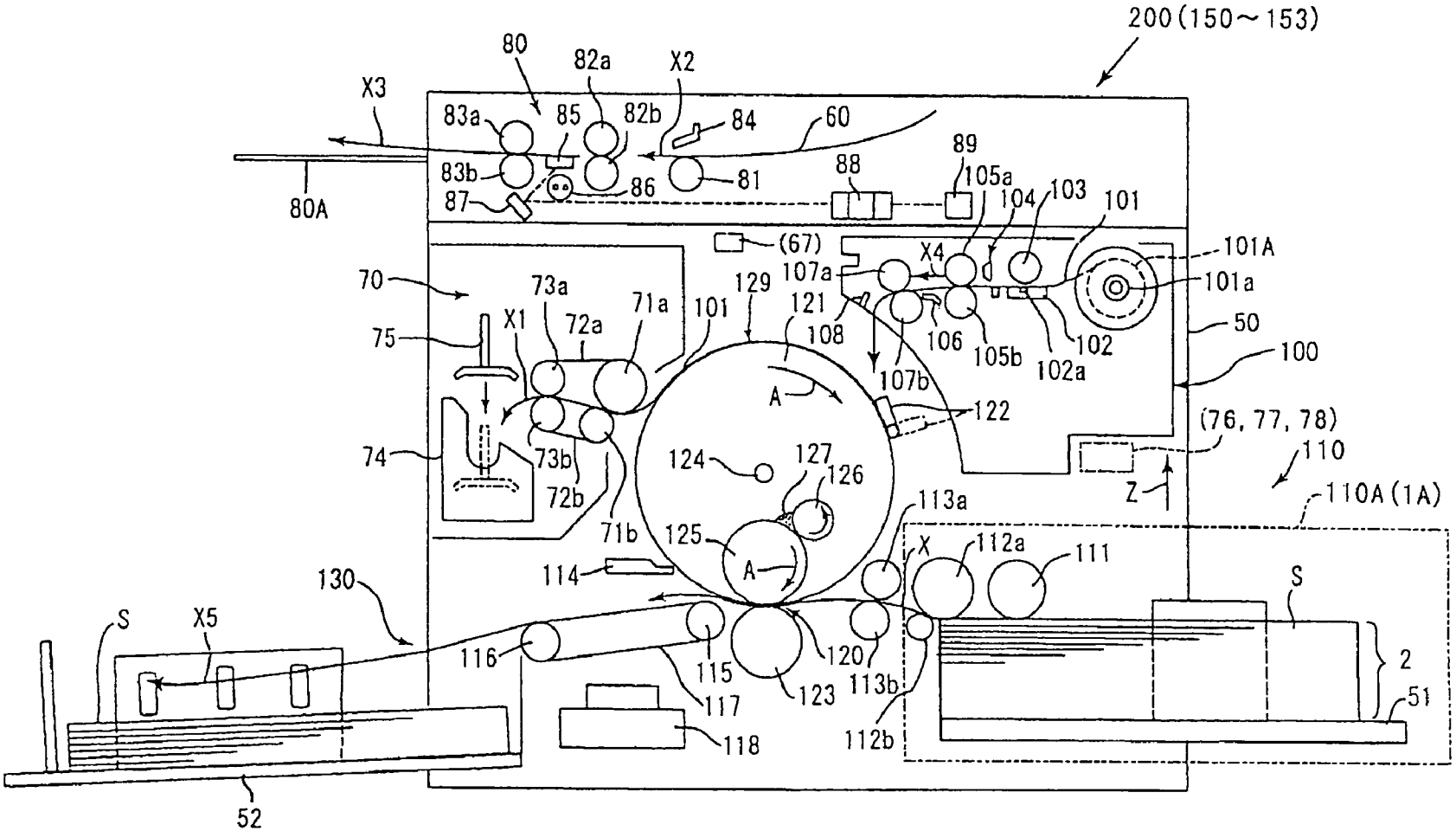
FIG. 19 is a front view showing the overall configuration of the main unit of the stencil printing apparatus of FIG. 18.

Since it is possible to use an activation energy-curable ink in the stencil printing apparatus shown in FIGS. 18 and 19, an activation energy curing fixing device 201 for curing this activation energy curable ink is installed adjacent to the paper discharge side of the stencil printing apparatus of FIG. 19. An ultraviolet radiation curable ink is used as one example of an activation energy curable ink, and an ultraviolet radiation curing fixing device is used as one example of the activation energy curing fixing device.

In FIGS. 18 and 19, a paper feeding part 110 is disposed in the right side of the stencil printing apparatus main unit 200. As mentioned above, the activation energy curing fixing device 201 is installed adjacent to the paper discharge side of the stencil printing apparatus main unit 200. An activation energy lamp, a motor and belt for conveying paper, and a suction fan are incorporated inside this activation energy curing fixing device 201. The configuration is such that the activation energy curable ink is then fixed onto a sheet of paper inside the activation energy curing fixing device 201, and the printed and fixed sheet of paper is discharged to the paper discharging tray 52 by belt and suction conveying.

The internal configuration of the activation energy curing fixing device 201, for example, is the same as the UV irradiation device that serves as the ultraviolet irradiation device (2) shown in FIG. 1 of Japanese Patent Laid-open Publication No. 2006-281658. In relation to this, a configuration that is the same as that of the stencil printing control device (55) disclosed in FIG. 4 of the above-mentioned Japanese Patent Laid-open Publication No. 2006-281658 is disposed in the stencil printing apparatus main unit 200 shown in FIG. 19.

Next, the overall configuration of the stencil printing apparatus main unit 200 will be explained by referring to FIG. 19.

In FIG. 19, 50 shows the device main unit that constitutes the framework of the stencil printing apparatus main unit 200. As shown in this drawing, the part indicated by 80 in the upper portion of the device main unit 50 shows a document reader as a document reading device, the part indicated by 100 therebelow shows a plate-making part as a digital thermal stencil type plate-making device, the part indicated by 129 to the left side of the plate-making part 100 shows a printing drum part as a printing drum device in which printing drum 121 comprises a porous cylindrical plate cylinder in the outer circumferential part, the part indicated by 120 below the printing drum 121 shows a printing pressure part as a printing pressure device, the part indicated by 70 to the left of the printing drum 121 shows a plate discharge part as a plate discharge device, the part indicated by 110 below the plate-making part 100 shows a paper feeding part as a paper feeding device, and the part indicated by 130 to the left of the printing pressure part 120 and below the plate discharge part 70 shows a paper discharging part as a paper discharging device, respectively.

In FIGS. 18 and 19, 150 through 153 shown in parentheses together with the reference numeral of the stencil printing apparatus main unit 200 represent a stencil printing apparatus main unit related to a first embodiment and modifications 1 through 3 thereto, which will each be explained below, and make a distinction with the stencil printing apparatus main unit 200 that applies the present invention.

Further, in FIG. 19, 76 through 78, which are indicated by a two-dot chain line, represent controlling means related to the modifications 1 through 3 of the first embodiment that will be explained hereinbelow, 67, which is indicated by a two-dot chain line in the same drawing represents a temperature detection sensor as temperature detection means for detecting the temperature inside the stencil printing apparatus main units 150 through 153 and 200, respectively. Controlling means 76 through 78 and temperature detection sensor 67 are used in the to-be-described first embodiment and modifications 1 through 3 as mentioned above, but were shown in FIG. 19 to expedite the drawings.

The document reader 80 has the function of reading an image on the surface of a document 60 that is moved from atop a not-shown document holding tray; the plate-making part 100 has the functions of reproducing, feeding and conveying a master 101 wound in the shape of a roll; the printing drum 129 has the functions of winding the reproduced master 101 onto the outer peripheral face thereof and supplying the ink to the reproduced master 101 on the printing drum 121; the printing pressure part 120 has the functions of pressing a sheet of paper S as a sheet-shaped recording medium/printing medium onto the printing drum 121 in accordance with pressure means that will be explained below, and forming a printing image on the sheet of paper S; the plate discharge part 70 has the functions of stipping a used master 101 from the outer peripheral face of the printing drum 121, and discharging same inside a plate discharge box 74; the paper feeding part 110 has the function of supplying a sheet of paper S loaded on top of a paper feeding tray 51 as a paper feeding holder between the printing drum part 129 and the printing pressure part 120; and the paper discharging part 130 has the function of discharging the sheet of paper S that has been printed in accordance with the printing drum part 129 and the printing pressure part 120 into a paper discharge tray 52.

Furthermore, the sheet-shaped recording medium (may also be referred to simply as the "sheet" hereinafter) and printing medium include paper used as printing paper (including thick paper, postcards, envelopes, regular paper, and thin paper), enamel paper (including coated paper, art paper and the like), OHP sheets or OHP film, and tracing paper.

The fundamental overall operation of the stencil printing apparatus main unit will be explained by referring to FIGS. 19 and 20.

Figure 20:
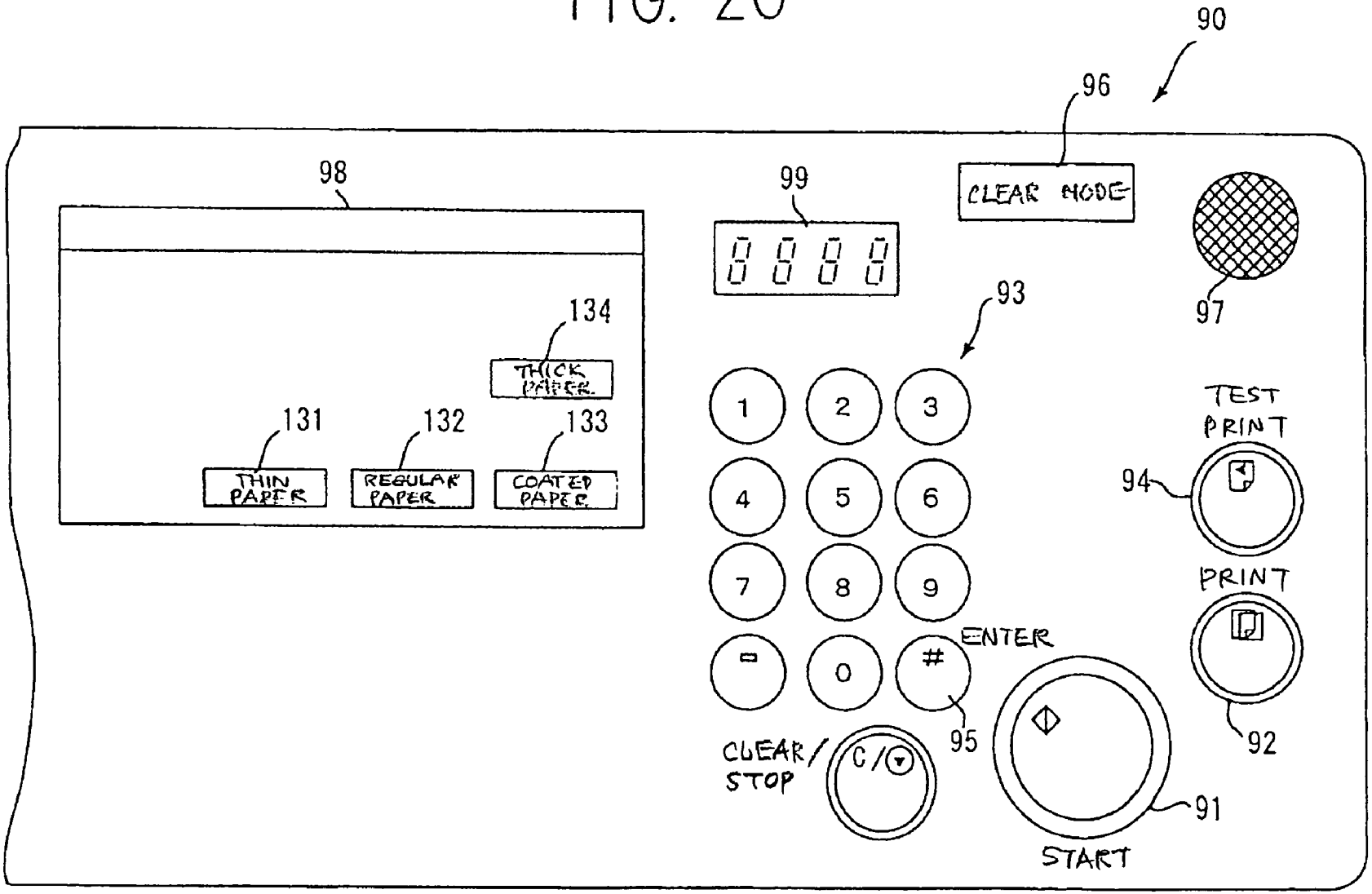
FIG. 20 is a plan view of the operation panel utilized in the main unit of the stencil printing apparatus of FIG. 18.

First, the user places and sets a document 60 having an image to be printed on a not-shown document loading tray disposed in the upper part of the document reader 80, and presses the plate-making start key 91 on the operation panel 90 shown in FIG. 20. Pressing this plate-making start key 91 generates a plate-making start signal, and this signal acts as a trigger by which a plate discharge process is executed first. That is, in this state, a used master 101, which was used in the previous printing, remains mounted as-is on the outer peripheral face of the printing drum 121 (outer peripheral face of the plate cylinder). The printing drum 121 is connected to printing drum driving means (not shown, but, for example, a main motor) by way of a not-shown drive mechanism, and is rotationally driven in accordance with printing drum driving means.

The printing drum 121 rotates in the opposite direction of the direction of the arrow A in the drawing, and when the rear end part of the used master 101 mounted to the outer peripheral face of the printing drum 121 approaches the pair of discharge-plate stripping rollers 71*a*, 71*b* of the plate discharging part 70, the one discharge-plate stripping roller 71*b* picks up the rear end part of the used master 101 as the same pair of rollers 71*a*, 71*b* are rotating, and the used master 101 is gradually stripped off from the outer peripheral face of the printing drum 121 and discharged inside the plate discharging box 74 while being conveyed in the direction of the arrow X1 by discharge-plate stripping conveyor device, which is configured by a pair of discharge-plate conveyor belts 72*a*, 72*b* suspended between the pair of discharge-plate stripping rollers 71*a*, 71*b* and a pair of plate discharging rollers 73*a*, 73*b* disposed leftwardly of the pair of discharge-plate stripping rollers 71*a*, 71*b*, and the so-called plate discharging process ends. The printing drum 121 continues to rotate in the counterclockwise direction at this time. Thereafter, the discharged used master 101 is compressed inside the plate discharging box 74 in accordance with a compressing plate 75.

In parallel with the plate discharging process, the document reader 80 operates and a document read is performed. That is, the document 60, which had been placed on the not-shown document loading tray, is supplied to an exposure reader while being conveyed from the direction of arrow X2 to the direction of arrow X3 (referred to as "document conveying direction X2" hereinafter) in accordance with the respective rotations of a separation roller 81, a pair of front document conveying rollers 82*a*, 82*b* and a pair of rear document conveying rollers 83*a*, 83*b*. When the document 60 consists of multiple sheets, a separation blade 84 operates at this time and only the lowermost of these documents is conveyed.

The upper-side rear document conveying roller 83*a*, for example, is rotationally driven in accordance with a document conveying motor (not shown) comprising a stepping motor. The upper-side front document conveying roller 82*a* is rotationally driven in accordance with the above-mentioned document conveying motor by way of a timing belt (not shown) that is suspended between the upper-side rear document conveying roller 83*a* and the upper-side front document conveying roller 82*a*, and the respective rollers 82*b*, 83*b* are each rotated in a driven condition.

The image read of the document 60 is carried out in accordance with the reflected light from the surface of the document 60, which is irradiated by a fluorescent light 86 while being conveyed over a contact glass 85, being reflected by a mirror 87 and passing through a lens 88, thereby being made incident on an image sensor 89 comprising a CCD (an opto-electric conversion device such as a charge-coupled device). The document 60 from which this image was read, is discharged onto a document tray 80A.

The optical information (image data) of the document 60 is opto-electrically converted by an image sensor 89, and this analog electrical signal is inputted into an analog/digital (A/D) converter (not shown), and converted to a digital image signal. This digital image signal is subjected to image processing for use as a stencil in an image processor (not shown) inside a not-shown controller, and a digital image signal related to binary black and white picture elements (pixels), which have undergone this image processing, is inputted to a not-shown thermal head drive controller. This thermal head drive controller mainly controls individual heating elements 102*a* of the thermal head 102 shown in FIG. 19 by way of a thermal head drive circuit (not shown), and carries out a control operation upon receiving an instruction from not-shown controlling means.

Furthermore, the optical information (image data) inputted to the above-mentioned A/D converter is not limited to information read by the above-mentioned CCD, but rather, for example, may also be information from a contact image sensor (CIS). Further, the digital image data inputted to the thermal head drive controller inside the above-mentioned not-shown controller may also be a digital image signal sent from a computer, such as a personal computer.

The digital image signal inputted to the thermal head drive controller inside the above-mentioned not-shown controller is a digital image data signal generated as a signal for use in thermal head driving, and is sent to the thermal head 102 via a thermal head drive circuit (not shown).

Meanwhile, plate-making and feeding processes are carried out based on the digitalized image information (digital image signal) in parallel to this document scanning and image reading operation. That is, the above-mentioned plate-making start signal serves as the trigger, and a stepping motor (not shown) connected to a platen roller 103 is rotationally driven, in accordance with which the master 101 is drawably set by way of a not shown master support member, and the master 101 is drawn out from the master roll 101A, which is formed by being wrapped in a roll shape around a core 101*a*. At this time, the master 101 is conveyed toward the downstream side of the sub-scanning direction X4 indicated by the arrow X4 in the drawing (also referred to as the "master conveying direction X4" hereinafter) in accordance with the fixed rate rotation of a pair of tension rollers 105*a*, 105*b* and the platen roller 103 as master conveying means, which is pressed against a thermal head 102 via the master 101.

A large number of micro heating elements 102*a*, which are arrayed in a line in the main scanning direction of the thermal head 102 relative to the conveyed master 101, are individually regioselectively heated in accordance with a digital image data signal sent from the thermal head drive controller inside the above-mentioned not-shown controller, and the thermoplastic resin film portion of the master 101, which is making contact with the heated heating elements 102*a*, is heated and undergoes fusion piercing. By regioselectively fusion piercing the master 101 in accordance with image information like this, the image information is written to the master 101 as a perforated pattern.

The platen roller 103 is connected to the above-mentioned not-shown stepping motor by way of rotation transmission members (not shown) such as a timing belt and gears, and is rotated in accordance with the stepping motor. The rotational driving force of the above-mentioned stepping motor is transmitted to a pair of tension rollers 105*a*, 105*b* by way of the gears and other rotation transmission members (not shown) and to an upper-and-lower pair of reversing rollers 107*a*, 107*b* by way of an electromagnetic clutch (not shown). Furthermore, the device may also be such that a different stepping motor from the above-mentioned stepping motor, which rotates a drive roller of the reversing rollers 107*a*, 107*b*, is allocated instead of the above-mentioned electromagnetic clutch.

The thermal head 102 functions as reproducing means for regioselectively heating, fusion piercing and reproducing a master 101 by regioselectively heating a large number of heating elements 102*a* based on a thermal head driving signal such as a digital image data signal that has been processed and sent by a thermal head drive controller of the not-shown controller via the above-mentioned image processor, either by way of the image sensor 89 and the respectively not-shown above-mentioned A/D converter and above-mentioned image processor as described hereinabove, or by way of a not-shown personal computer controller and interface device and data expansion part for receiving a digital image signal from a not-shown personal computer or the like. The thermal head 102 is freely contact/separated with respect to the platen roller 103 via the master 101 in accordance with a not-shown known contact/separating means.

The master 101 used in FIGS. 18 and 19, for example, may include a thermoplastic resin film, and a laminated structure, which pastes together either a Japanese paper fiber or synthetic fiber, or a combination of Japanese paper fiber and synthetic fiber with a porous support member. A polyethylene terephthalate (PET) film, for example, may be used as the thermoplastic resin film.

The plate-making part 100 configures a plate-making unit that is freely detachable from the device main unit 50 via known attaching/detaching means. The above-mentioned attaching/detaching means, for example, may include a combination of a cross-sectional U-shaped guide member for guiding the plate-making unit disposed on the device main unit 50 side, and a protruding member, which is disposed on the plate-making unit side and is slidable with respect to the above-mentioned guide member. Space saving and downsizing in the height direction Z in the paper feeding unit 110A is required because the not-shown guide member is disposed on the device main unit 50 side like this.

The leading edge of reproduced master 101 on which image information has been written is sent out toward the plate cylinder outer peripheral part side of the printing drum 121 in accordance with the pair of reversing rollers 107*a*, 107*b*, the direction of progress is further changed downwardly by a plate feeding guide plate 108, and hangs down toward the printing drum 121 master damper 122, which is open in the plate feeding location shown by the two-dot chain line in FIG. 19. The used master 101 has already been removed from the printing drum 121 at this time in accordance with the plate discharging process.

Then, when the leading edge of the reproduced master 101 is clamped and held by the master damper 122 at a predetermined timing in accordance with the operation of a not-shown opening-and-closing device, which is disposed on the device main unit 50 side and opens and closes the master damper 122, the printing drum 121 gradually winds the reproduced master 101 onto the peripheral face while rotating in the direction of arrow A in the drawing (the clockwise direction). The rear end part of the reproduced master 101 is cut to a predetermined length in accordance with a cutter 104 subsequent to completion of plate-making, and the plate-making and plate feeding processes end at the stage at which one reproduced master 101 plate has been completely wound and set on the peripheral face of the printing drum 121.

Thereafter, in accordance with the rotation of the platen roller 103, the pair of tension rollers 105*a*, 105*b* and the pair of reversing rollers 107*a*, 107*b*, the leading edge of the cut master 101 that remains on the upstream side is conveyed toward the nip part of the pair of reversing rollers 107*a*, 107*b*. The leading edge of the master 101 conveyed like this is detected in accordance with a not-shown master leading edge detection sensor, and when it is determined that the leading edge of the master 101 occupies an initial location, the rotation of the platen roller 103, the pair of tension rollers 105*a*, 105*b* and the pair of reversing rollers 107*a*, 107*b* is stopped, and these rollers transition to a waiting-for-plate-making state in preparation for the next plate-making operation. The initial location of the master 101, for example, is set beforehand to the location at which the leading edge of the master 101 sticks out slightly forward of the location where this master 101 is held between the nip part of the pair of reversing rollers 107*a*, 107*b*.

Next, the printing process is commenced.

First, the uppermost one sheet of the papers S loaded on top of the paper feeding tray 51 is drawn out in accordance with a paper feeding roller 111, is further separated by the cooperative operation of a pair of separation rollers 112*a*, 112*b* and fed in the sheet feeding direction X toward a pair of resist rollers 113*a*, 113*b*, and, in accordance with the pair of resist rollers 113*a*, 113*b*, is also fed between the printing drum 121 and a press roller 123 in the printing pressure part 120 at a predetermined timing in synch with the rotation of the printing drum 121. This press roller 123 is designed to be freely contact-separated with respect to the outer peripheral face of the printing drum 121 in accordance with not-shown known press roller displacing means, and functions as pressing means for pressing a sheet of paper S that has been fed to the printing drum 121 on which a reproduced master 101 is wrapped around the outer peripheral face, and forming a printing image on the sheet of paper S. Then, when the fed sheet of paper S is inserted between the printing drum 121 and the press roller 123, this sheet of paper S is pressed against the reproduced master 101 that is wrapped around the outer peripheral face of the printing drum 121 in accordance with the press roller 123, which had been downwardly separated from the outer peripheral face of the printing drum 121, swinging upward. In so doing, at the same time as the reproduced master 101 is being firmly stuck to the outer peripheral face of the printing drum 121 in accordance with an adhesive force resulting from the viscosity of the ink that bleeds from the porous part of the printing drum 121, ink also bleeds from the perforated pattern part of the reproduced master 101 and this bled ink is transferred to the surface of the sheet of paper S, forming a printing image.

At this time, ink is supplied from an ink supply tube 124, which also serves as a support shaft, to an ink reservoir 127 formed between an ink roller 125 and a doctor roller 126 on the inner periphery side of the printing drum 121, and the ink is supplied to the inner periphery side of the printing drum 121 by the ink roller 125, which is in rolling contact with the inner peripheral face while rotating in the same direction as the rotating direction of the printing drum 121 and in synch with the rotating speed of the printing drum 121.

Furthermore, the ink supplying tube 124, ink roller 125 and doctor roller 126 configure ink supplying means for supplying the ink to the reproduced master 101 on the printing drum 121. Pressing means is not limited to the press roller 123, and a pressure cylinder that is substantially the same diameter as the diameter of the printing drum (plate cylinder) 121 can also be used, and, of course, the present invention may also be applied to a pressure cylinder type stencil printing apparatus like this.

As described hereinabove, the printing drum 121, the above-mentioned ink supplying means, and the press roller 123 configure printing image forming means for forming a printing image in accordance with ink on a sheet of paper S that has been fed by a paper feeding part 110.

For example, W/O type emulsion ink is preferably used as the ink used when printing on high-quality non-coated paper. To make the explanation brief and concise, an example of when an ultraviolet light curable ink is used as the activation energy curable ink in the stencil printing apparatus shown in FIGS. 18 and 19 will be explained below. Referring simply to ink hereinbelow will signify the activation energy curable ink (ultraviolet light curable ink).

The sheet of paper S on which a printing image was formed in the printing pressure part 120 is stripped from the printing drum 121 in accordance with a discharge-paper stripping claw 114 in the paper discharging part 130, and while being suctioned by a suctioning fan 118, is suction-clamped to a porous conveyor belt 117 suspended around a suction-clamped discharge-paper inlet roller 115 and a suction-clamped discharge-paper outlet roller 116, conveyed toward the paper discharging tray 52 as indicated by the arrow X5 in accordance with the counterclockwise rotation and travel of this conveyor belt 117, and sequentially discharged and stacked on top of the paper discharging tray 52. The so-called plate-mounted printing ends in this manner.

Subsequent to the end of plate-mounted printing, the press roller 123 moves away from the printing drum 121, and the printing drum 121 returns to the initial location (home position) in which the master damper 122 is substantially directly above in FIG. 19, transitioning to a waiting-to-print state.

Next, setting a desired printing speed value in accordance with pressing a not-shown printing speed setting key disposed on the operation panel 90 shown in FIG. 20, and either beforehand or afterwards, setting the number of sheets to be printed via a numeric key pad 93 on the operation panel 90 and pressing the print start key 92 causes the respective processes of paper feeding, printing and paper discharging to be repeatedly carried out at the set printing speed and at the set number of sheets to be printed by the same process as the above-described plate-mounted printing, and the entire stencil printing process ends.

In FIG. 19, the part enclosed within the two-dot chain line, exclusive of the pair of resist rollers 113*a*, 113*b*, shows a paper feeding unit 110A that is configured to be freely detachable from the device main unit 50 via attaching/detaching means including a not-shown screw or other such tightening means. The paper feeding unit 110A is configured as the above-described friction type sheet feeding device. The paper feeding unit 110A uses the pair of separation rollers 112*a*, 112*b* as separating means, but means that combines a paper feeding roller with a friction pad, which is the friction member, may also be used.

In FIG. 19, 1A, which is shown in parentheses together with the reference numeral of the paper feeding unit 110A, represents a paper feeding unit related to the below-explained first embodiment and so forth, which is configured to be freely detachable from the device main unit 50 via attaching/detaching means such as a not-shown screw or other such tightening means.

Further, the air-type paper feeding device, for example, may also be configured so as to be combined with a volume paper feeding unit that is capable of feeding large quantities of paper, and to be mountable to the device main unit 50 as an externally mounted option.

A supplementary explanation of the operation panel 90 shown in FIG. 20 will be given here. The operation panel 90 is disposed on one side of the top of the document reader 80. As shown in detail in FIG. 20, a widely known plate-making start key 91, print start key 92, numeric key pad 93, test sheet key 94, enter key 95, clear mode key 96, touch panel 98 and display 99 are disposed on the operation panel 90. Further, elements that function as notifying means and sheet type recognizing means for recognizing the type of sheet are also disposed on the operation panel 90.

The plate-making start key 91 functions as operation starting means for starting the series of processes (operations) from the document image read to the plate discharging, plate making, plate feeding, paper feeding, plate-mounted printing, and paper discharging processes; the numeric key pad 93 has functions for inputting and setting the number of sheets to be printed; the print start key 92 has a function for carrying out the startup of the printing operation for the number of sheets to be printed, which was inputted and set in accordance with the numeric key pad 93; and the test sheet key 94 has a function for starting up a test sheet printing operation. The enter key 95 has a function for determining and setting a numeric value for each type of setting, and the clear mode key 96 has a function for deleting and clearing various mode setting states. These respective keys are pressed when the user wishes to realize these functions.

The touch panel 98 is driven in accordance with a LCD (liquid crystal display) drive circuit comprising a not-shown touch panel drive circuit, and is configured so as to enable the black-and-white inverted video display and selection-and-setting of various modes and various types of selection setting means (the above-described sheet type setting means) displayed on a well-known touch panel system.

Displaying means or notifying means comprising LCD screens arranged on the touch panel 98 are for displaying or notifying the fact that the ink being used or the wind velocity in accordance with rotation speeds of the respective sirocco fans 15*a*, 15*b*, 41*a*, 41*b* shown in FIG. 1 and so forth that will be explained below does not correspond to thin paper, regular paper, coated paper or thick paper.

Sheet type setting means includes sheet type recognizing means that makes it possible to recognize the sheet type in accordance with selecting and setting thin paper, regular paper, coated paper or thick paper as the sheet. Specifically, sheet type setting means is configured from a thin paper setting key 131, a regular paper setting key 132, a coated paper setting key 133 and a thick paper setting key 134 provided on the touch panel 98.

For example, when coated paper (including art paper and the like) is selected and set using the coated paper setting key 133, because the surface thereof is extremely smooth (slippery), it is not possible to separate the sheets of paper S one at a time using the friction separation system of the paper feeding unit 110A shown in FIGS. 18 and 19. For this reason, not-shown controlling means is configured so as to execute a display or notification to this extent (to the effect to mount the paper feeding unit of the air-type paper feeding device) on the above-mentioned LCD screen of the touch panel 98, and, in addition, to stop paper feeding, printing and paper discharging operations by placing the printing pressure part 120, printing drum part 129 and paper discharging part 130 of the stencil printing apparatus main unit 200 comprising the paper feeding part 110 in a non-operational state based on the coated paper setting-related signal from the coated paper setting key 133.

The first embodiment of the present invention will be explained by referring to FIGS. 1 through 9C.

FIGS. 1 and 2 show the length of the paper feeding tray 3 and the paper stack 2 on this paper feeding tray 3 with respect to the sheet feeding direction X as being exaggeratedly long in this direction X. Further, the drawings of the components (the side discharge relay tube 43 and side discharge nozzles 42*c*, 42*d* shown in FIG. 2), which configure a side discharge unit 40A that will be explained hereinbelow, and which are disposed on the interior-most side of the paper, have been omitted from FIG. 1 to make the drawing concise.

The first embodiment differs from the air-type paper feeding device 500 shown in FIGS. 15 and 16 only in that an air-type paper feeding device 1 uses a paper feeding unit 1A instead of paper feeding unit 500A as shown in FIGS. 1 and 2. The paper feeding unit 1A of the air-type paper feeding device 1 differs from the paper feeding unit 500A of air-type paper feeding device 500 mainly in that: paper feeding unit 1A uses a suctioning unit 10A instead of suctioning unit 10 of paper feeding unit 500A, and uses a side discharge unit 40A as air-suction separating means instead of side discharge unit 40 of paper feeding unit 500A;, in line with employing the suctioning unit 10A and side discharge unit 40A, a to-be-explained air suctioning drive source configuring the suctioning unit 10A and a to-be-explained side air blowing drive source configuring the side discharge unit 40A are configured in a characteristic layout mode as will be explained hereinbelow; and paper feeding unit 1A uses a plurality (two in this embodiment) of sirocco fans 15*a*, 15*b* as the above-mentioned air suctioning drive source configuring suctioning unit 10A, a plurality (two in this embodiment) of sirocco fans 41*a*, 41*b* as the above-mentioned side air blowing drive source configuring side discharge unit 40A, and a noise-quieting cover 35 (indicated by the bold dotted line in FIGS. 1 and 2) as a cover member for covering three drive source/driving means comprising the suctioning belt drive motor 47.

Other than the above-mentioned points of difference, which will be explained in detail hereinbelow, the paper feeding unit 1A of the air-type paper feeding device 1 is the same as the paper feeding unit 500A of the air-type paper feeding device 500 shown in FIGS. 15 and 16. In FIGS. 18 and 19, the air-type paper feeding unit 1A shown in parentheses together with friction-type paper feeding unit 110A indicates that paper feeding unit 1A is mounted and used in stencil printing apparatus main unit 150 shown in parentheses in the same drawing instead of paper feeding unit 110A.

The suctioning unit 10A of the first embodiment mainly differs from the prior art suctioning unit 10 shown in FIGS. 15 and 16 in that: two sirocco fans 15*a*, 15*b* are disposed as air suctioning drive sources, instead of a single air suctioning fan 15, in a characteristic communicatively connected state above and in the vicinity of the suctioning belt 11 as shown in FIGS. 1 through 3; the suctioning apertures 13*a* of the suctioning relay tube (duct) 13 are communicatively connected to at least both sides (two locations in this embodiment) of the suctioning chamber 12 with respect to the sheet width direction Y; in line with this, the suctioning relay tube 13 is communicatively connected to the suctioning drive source chamber 17 from both sides of the suctioning chamber 12 with respect to the sheet width direction Y; and suctioning belt drive motor 47, which serves as driving means for driving the suctioning belt 11, is disposed in the vicinity of sirocco fan 15*a* (air suctioning drive source).

As shown in FIGS. 6, 7 and 9A through 9C, sirocco fan 15*a* comprises an air inlet 15*a*1 for suctioning air, and an air outlet 15*a*2 for discharging air. Similarly, sirocco fan 15*b* comprises an air inlet 15*b*1 for suctioning air, and an air outlet 15*b*2 for discharging air. Then the two sirocco fans 15*a*, 15*b* are disposed such that the air outlet 15*a*2 of the upstream sirocco fan 15*a* is communicatively connected to the air inlet 15*b*1 of the adjacent downstream sirocco fan 15*b* of the air discharge route (direction of the air a flow).

Figure 7:
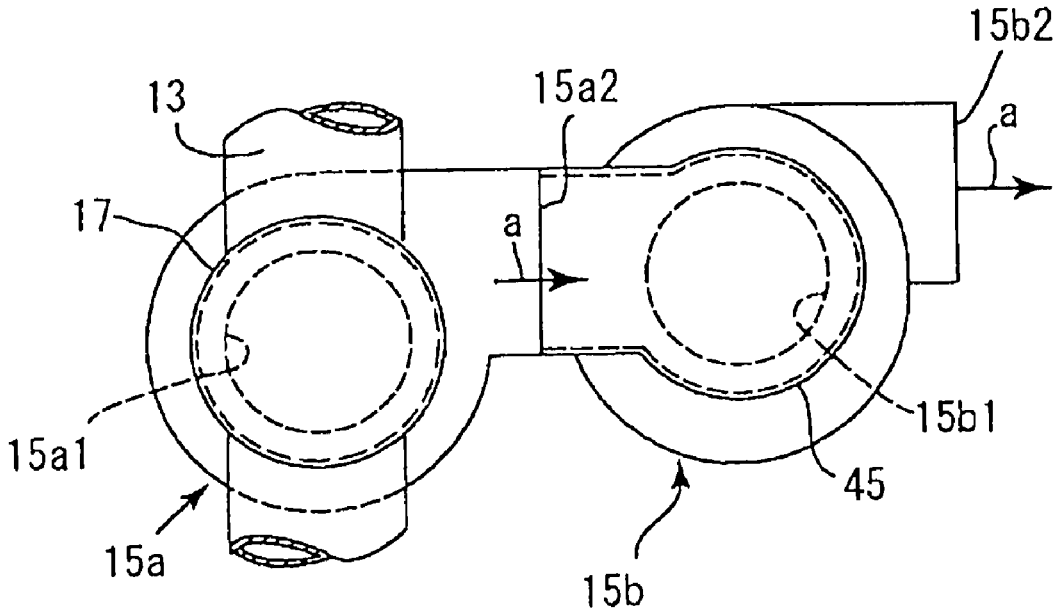
FIG. 7 is a bottom view of FIG. 6.

A system for raising the static pressure in a DC fan is to use sirocco fans 15*a*, 15*b* as the air suctioning drive fans serving as the air suctioning drive source, and to dispose these sirocco fans 15*a*, 15*b* as shown in the above-mentioned drawings. That is, subsequent to communicatively connecting the suctioning drive source chamber 17 to the crosswise suctioning relay tube (duct) 13 the same as shown in FIGS. 1 through 3, the air inlet 15*a*1 of the upstream sirocco fan 15*a* is communicatively connected to the suctioning drive source chamber 17 as shown in FIGS. 6 and 7.

Then, a fan connection duct 45 is communicatively connected to the air outlet 15*a*2 of the upstream sirocco fan 15*a*, subsequent to which the fan connection duct 45 is communicatively connected to the air inlet 15*b*1 of the downstream sirocco fan 15*b*, the furthest downstream air outlet 15*b*2 of the sirocco fan 15*b* is opened and the air is discharged. In other words, the configuration is such that the two sirocco fans 15*a*, 15*b* are communicatively connected in series.

Naturally, air leaks are prevented in the connecting parts of the suctioning relay tube 13 and the suctioning drive source chamber 17, the connecting parts of the suctioning drive source chamber 17 and the air inlet 15*a*1 of sirocco fan 15*a*, the connecting parts of the air outlet 15*a*2 of sirocco fan 15*a* and the fan connection duct 45, and the connecting parts of the air inlet 15*b*1 of sirocco fan 15*b* and the fan connection duct 45 in accordance with appropriate interconnecting shapes and the application of suitable sealing tape so that there are no air leaks.

The respective sirocco fans 15*a*, 15*b* have the same static pressure specifications, that is, these fans 15*a*, 15*b* share the same shape, dimensions and other characteristics, to include static pressure specifications. Using a configuration that communicatively connects the two sirocco fans 15*a*, 15*b* in series makes it possible to increase static pressure by approximately 50% compared to either one of the sirocco fans 15*a*, 15*b* by itself. For example, if it is assumed that a single sirocco fan has a hypothetical static pressure of 400 Pa, a configuration that connects the sirocco fans 15*a*, 15*b* in series like that shown in FIGS. 6 and 7 was able to increase the static pressure by approximately 50% to 600 Pa in this embodiment according to the results of comparative experiments conducted using either one of the two sirocco fans 15*a*, 15*b* alone.

Generally speaking, in a case where two sirocco fans having the same static pressure specifications are communicatively connected in series, theoretically the static pressure should roughly double, but it was learned that the static pressure increased approximately 50% due to the friction, load resistance and the like generated by the suctioning drive source chamber 17 and fan connection duct 45.

Furthermore, since the respective sirocco fans 15*a*, 15*b* comprise DC fans, it is also possible to change the static pressure and wind velocity by varying the respective rotation speeds, but in this embodiment, the respective sirocco fans 15*a*, 15*b* are set to be rotationally driven at the maximum rotation speed.

In this embodiment, because the suctioning belt drive motor 47 is disposed in the vicinity of sirocco fan 15*a* as explained hereinabove, the drive force transmission system of the suctioning belt drive motor 47, which drives the suctioning belt 11, changes from the suctioning belt drive motor 47 direct-connect drive system via the coupling 14*c* shown in FIG. 16 to drive force transmission means using a geared belt 48, geared drive pulley 47*a* and geared pulley 14*d* as shown in FIG. 2. That is, as shown in FIG. 2, drive force transmission means comprising the geared pulley 14*d*, which is fastened to one end of the shaft of the drive roller 14*a*, the geared drive pulley 47*a*, which is fastened to the output shaft of the suctioning belt drive motor 47, and the geared belt 48, which is suspended between the geared pulley 14*d* and the geared drive pulley 47*a*, is employed. Furthermore, drive force transmission means is not limited to the means shown in FIG. 2, and a row of gears may also be used.

In FIGS. 1 and 2, the suctioning belt 11, drive roller 14*a*, slave roller 14*b*, a single suctioning chamber 12, the crosswise suctioning relay tube 13, suctioning drive source chamber 17, respective sirocco fans 15*a*, 15*b*, fan connection duct 45, and suctioning belt drive motor 47 configure a suctioning unit 10A.

Within the above-mentioned suctioning unit 10A, the suctioning belt 11, suctioning chamber 12, crosswise suctioning relay tube 13, suctioning drive source chamber 17 and respective sirocco fans 15*a*, 15*b* configure air suctioning means.

Further, within the above-mentioned suctioning unit 10A, the suctioning belt 11, drive roller 14*a*, slave roller 14*b*, and suctioning belt drive motor 47 configure sheet feeding means for feeding a sheet of paper S held by suction in accordance with the above-mentioned air suctioning means.

The side discharge unit 40A, as described hereinabove, configures air separating means for separating sheets of paper S one at a time by blowing air on both side edge surfaces of a paper stack 2 loaded on the paper feeding tray 3. Air separating means comprises the above-described front discharge unit 22. This embodiment focuses in particular on the side discharge unit 40A of the configuration of the above-mentioned air separating means.

The side discharge unit 40A mainly differs from the pair of side discharge units 40 disposed opposite one another on the right and left sides of the paper stack 2 shown FIG. 16 in that the side discharge unit 40A: uses a plurality (two in the example of this embodiment) of sirocco fans 41*a*, 41*b* comprising DC fans as side air blowing drive sources as shown in FIGS. 1, 2, 4, 8 and 9 instead of the side air discharge fans 41 serving as the side air discharge drive sources, that is, uses sirocco fan 41*a*, which comprises an air inlet 41*a*1 for suctioning air and an air outlet 41*a*2 for discharging air, and sirocco fan 41*b*, which comprises an air inlet 41*b*1 for suctioning air and an air outlet 41*b*2 for discharging air; arranges sirocco fans 41*a*, 41*b* such that the air outlet 41*b*2 of the upstream sirocco fan 41*b* is communicatively connected to the air inlet 41*a*1 of the adjacent downstream sirocco fan 41*a* of the air discharge route (direction of the air a flow); disposes sirocco fan 41*b* of the upstream side of the side air discharge route in the vicinity of the air outlet 15*a*2 of the sirocco fan 15*b* in suctioning unit 10A; and uses a plurality of side discharge nozzles 42*a*, 42*b*, 42*c*, 42*d* comprising side air outlets 42o for blowing air onto the respective side edge surfaces of the paper stack 2, a side discharge relay tube (duct) 43, which is communicatively connected to each side air outlet 42*o* via the respective side discharge nozzles 42*a*, 42*b*, 42*c*, 42*d*, a side discharge drive source chamber 44, which is communicatively connected to the side discharge relay tube 43, and two sirocco fans 41*a*, 41*b*, which are communicatively connected to this side discharge drive source chamber 44.

Figure 8:
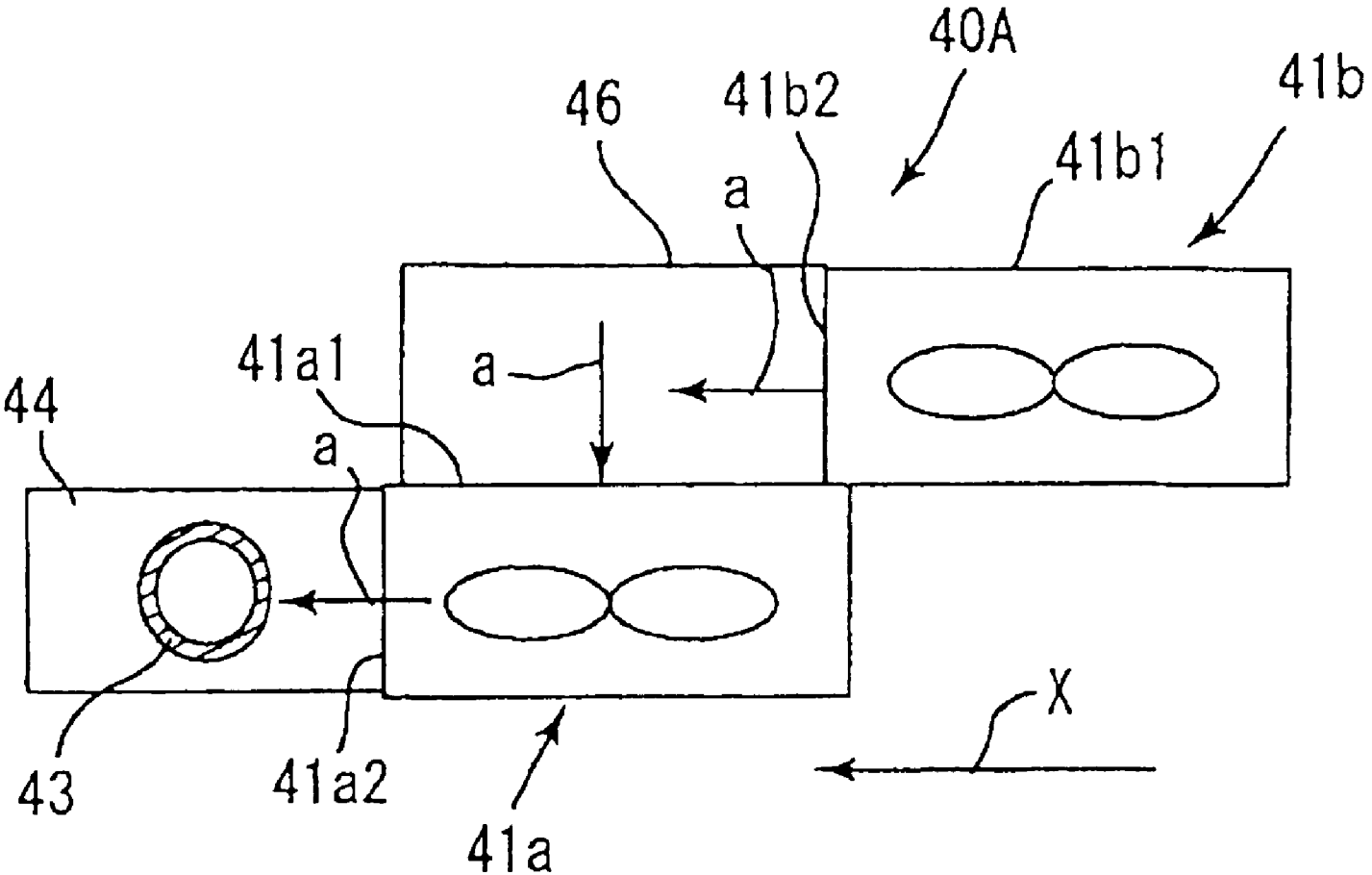
FIG. 8 is a schematic front view showing the essential part (the communicatively connected state of two sirocco fans) of the side discharge unit of FIG. 1.

In the example of this embodiment, the static pressure specifications of the sirocco fans 41*a*, 41*b*, for example, are the same as those of sirocco fans 15*a*, 15*b*, making these fans 15*a*, 15*b*, 41*a*, 41*b* common parts. A method for raising the static pressure in a DC fan is to use the sirocco fans 41*a*, 41*b* as the air blowing drive fans that serve as the side air blowing drive sources, and to dispose these sirocco fans 41*a*, 41*b* as shown in FIGS. 1, 2 and 8. That is, a fan connection duct 46 is communicatively connected to the air outlet 41*b*2 of the upstream sirocco fan 41*b*, and after that the fan connection duct 46 is communicatively connected to the air inlet 41*a*1 of the downstream sirocco fan 41*a*, the air outlet 41*a*2 of sirocco fan 41*a*, which is located the furthest downstream, is opened, side air is sent under pressure via the side discharge drive source chamber 44 and side discharge relay tube 43, and the side air is discharged from the side outlets 42*o* of the respective side discharge nozzles 42*a* through 42*d* and blown onto the respective side edge surfaces of the paper stack 2.

As described above, the respective side discharge nozzles 42*a*, 42*b*, 42*c*, 42*d* comprising the side air outlets 42o are communicatively connected to the two sirocco fans 41*a*, 41*b* via the side discharge relay tube 43 and the side discharge drive source chamber 44. Because of this, the side air a, which is generated in accordance with the in-line communicatively connected two sirocco fans 41*a*, 41*b* and sent under pressure at a high static pressure, passes through the side discharge drive source chamber 44 and side discharge relay tube 43 and is discharged from the side air outlets 42*o* of the respective side discharge nozzles 42*a*, 42*b*, 42*c*, 42*d*, thereby blowing on the respective side edge surfaces of the paper stack 2 and reliably separating the sheets of paper S one sheet at a time.

Naturally, air leaks are prevented in the connecting parts of the respective side discharge nozzles 42*a*, 42*b*, 42*c*, 42*d* and the side discharge relay tube 43, in the connecting parts of the side discharge relay tube 43 and the side discharge drive source chamber 44, the connecting parts of the side discharge drive source chamber 44 and the air outlet 41*a*2 of the sirocco fan 41*a*, the connecting parts of the air outlet 41*a*1 of the sirocco fan 41*a* and the fan connection duct 46, and in the connecting parts of the fan connection duct 46 and the air outlet 41*b*2 of sirocco fan 41*b* in accordance with appropriate interconnecting shapes and the application of suitable sealing tape so that there are no air leaks.

The respective sirocco fans 41*a*, 41*b* have the same static pressure specifications, that is, these fans 41*a*, 41*b* share the same shape, dimensions and other characteristics, to include static pressure specifications. Using a configuration that communicatively connects the two sirocco fans 41*a*, 41*b* in series makes it possible to increase static pressure by approximately 50% compared to either one of the sirocco fans 41*a*, 41*b* by itself. For example, if it is assumed that a single sirocco fan has a hypothetical static pressure of 400 Pa, a configuration that connects the sirocco fans 41*a*, 41*b* in series like that shown in FIGS. 1, 2, 4 and 8 was able to increase the static pressure by approximately 50% to 600 Pa in the example of this embodiment according to the results of comparative experiments conducted using either one of the sirocco fans 41*a*, 41*b* alone.

As explained hereinabove, in a case where two sirocco fans having the same static pressure specifications are communicatively connected in series, theoretically the static pressure should roughly double, but it was learned that the static pressure increased approximately 50% in this embodiment due to the friction, load resistance and the like generated by the fan connection duct 46, the side discharge drive source chamber 44 and the side discharge relay tube 43.

Since the respective sirocco fans 41*a*, 41*b* comprise DC fans in this embodiment, it is also possible to change the static pressure and wind velocity by varying the respective rotation speeds, but in the example of this embodiment, the respective sirocco fans 41*a*, 41*b* are normally set to be rotationally driven at 70% of the maximum rotation speed. That is, if the rated voltage of the respective sirocco fans 41*a*, 41*b*, for example, is 24V, the voltage is set at around 17V. Setting the rated voltage of the respective sirocco fans 41*a*, 41*b* at 24V will be explained below.

Figure 9C:
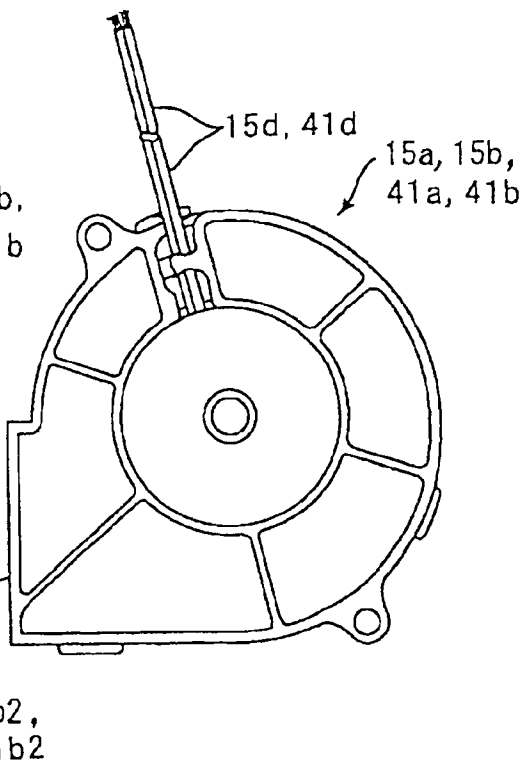
FIG. 9C is a plan view of this same fan.
Figure 9B:
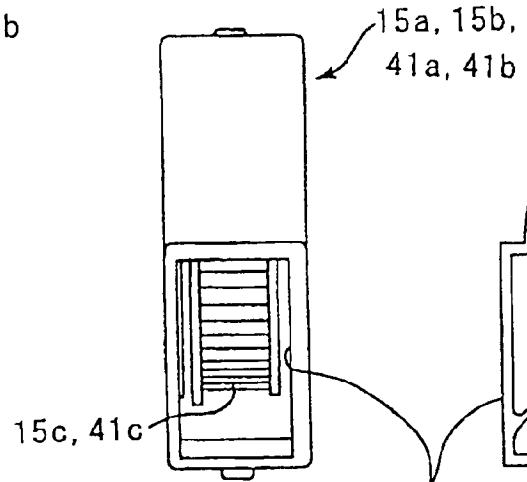
FIG. 9B is a right side view of this same fan.
Figure 9A:
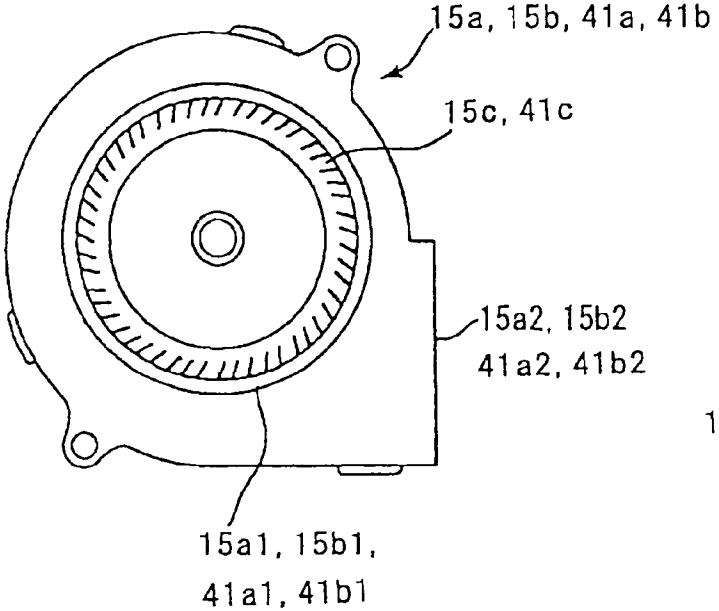
FIG. 9A is a bottom view showing an example of the sirocco fan product used in the first embodiment.

A concrete product example of the sirocco fans 41*a*, 41*b*, to include the above-described sirocco fans 15*a*, 15*b*, is as shown in FIGS. 9A through 9C. That is, in the drawings, 15*c*, 41*c* indicate the multi-blade fan provided in sirocco fans 15*a*, 15*b* and sirocco fans 41*a*, 41*b*; 15*d*, 41*d* indicate the respective lead lines that supply power to the DC (direct current) fan motor (also referred to as the "DC fan" hereinafter) provided in sirocco fans 15*a*, 15*b* and sirocco fans 41*a*, 41*b*. Furthermore, the name sirocco fan is a term widely used among persons skilled in the art, but the official name (scientific term) corresponds to centrifugal blower multi-blade fan.

Next, the characteristic configurations of the side discharge nozzles 42*a*, 42*b*, 42*c*, 42*d*, paper feeding tray 3 and side fence 5 will be explained by referring to FIGS. 1, 2, 4 and 5. The side fence 5 is a member that touches both side edge surfaces of the paper stack 2 with respect to the sheet width direction Y, and controls and positions the location of both side edges of the paper stack 2, and is disposed in pairs capable of moving in the sheet width direction Y. The side fences 5 in two places on the near side of the paper shown in FIG. 5 are rendered as if separated, but in actuality these side fences 5 are integrally connected at a not-shown location below the paper feeding tray 3, and the side fences 5 in the two places on the nearside of the paper are configured to move at the same time.

Figure 5:
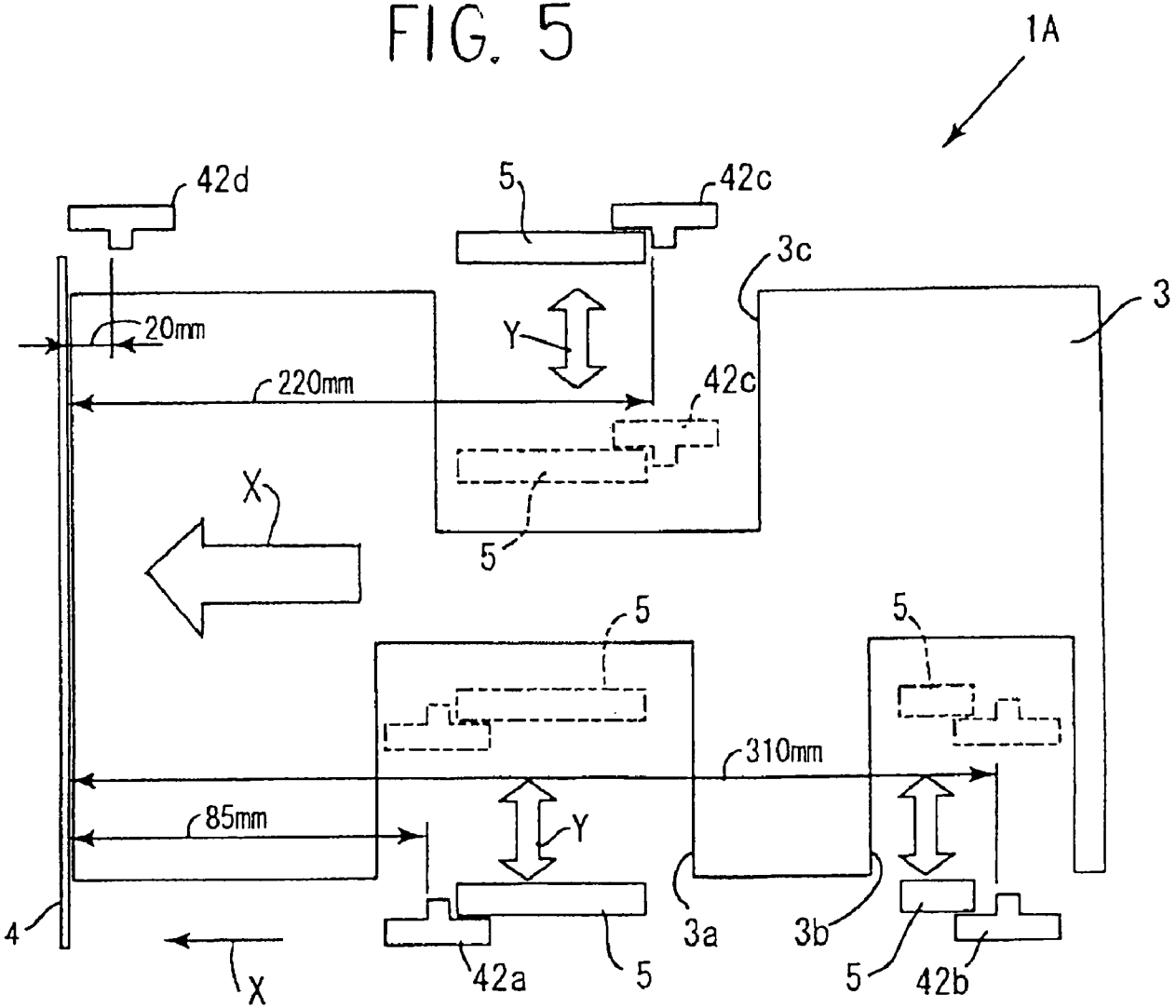
FIG. 5 is a schematic plan view showing the optimum layout location discovered in accordance with experimentation on the respective side discharge nozzles capable of being used with all paper (sheet) sizes and paper (sheet) types.

In the paper feeding tray 3 of this embodiment, notched parts 3*a*, 3*b*, 3*c* are formed at two places in the nearside of the paper and one place on the interior-most side of the paper shown in FIG. 5. The respective side fences 5 are configured so as to move with respect to the sheet width direction Y within the range of the respective notched parts 3*a*, 3*b*, 3*c* of the paper feeding tray 3.

The movement mechanism, which makes the respective side fences 5 slidingly movable within the range of the notched parts 3*a*, 3*b*, 3*c*, comprises a known configuration in which a recessed part (not shown), which is securely installed in a not-shown side plate of the air-type paper feeding device 1 provided below the paper feeding tray 3, and a protruding part (not shown), which is integrally formed on the bottom part of the respective side fences 5 project in the sheet width direction Y and loosely fit together. Furthermore, since the respective side discharge nozzles 42*a*, 42*b*, 42*c* are configured so as to interlock and move in the same direction with the movement of the respective side fences 5 with respect to sheet width direction Y as will be explained hereinbelow, it is preferable that the respective side fences 5 be fastened and held in the control location in accordance with clips or other such locking means so that the control location positioned in accordance with the respective side fences 5 does not deviate as a result of the counterforce of the side air discharged and blown out from the respective side discharge nozzles 42*a*, 42*b*, 42*c*.

The side fence 5 is installed in a location that does not interfere with the suctioning unit 10A (Refers to the suctioning belt 11, drive roller 14*a*, slave roller 14*b*, suctioning relay tube 13 and other such components and parts configuring the suctioning unit 10A. The same holds true hereinbelow.). The reason for this is so paper of a size that is smaller than the suctioning belt 11 with respect to the sheet width direction Y is also capable of passing through and being fed.

Further, the side fence 5 is slidingly movably supported with respect to the sheet width direction Y in accordance with the above-mentioned not-shown side plate of the air-type paper feeding device 1, but does not move up and down together with the paper feeding tray 3. This is because fixing the location of the respective side discharge nozzles 42*a*, 42*b*, 42*c*, 42*d* in a home position with respect to the height direction Z as shown in FIG. 4 makes it possible to reliably separate the papers one sheet at a time in accordance with the side air from the respective side discharge nozzles 42*a*, 42*b*, 42*c*, 42*d* even when there is a small final number of sheets of paper S remaining on the paper feeding tray 3.

Figure 4:
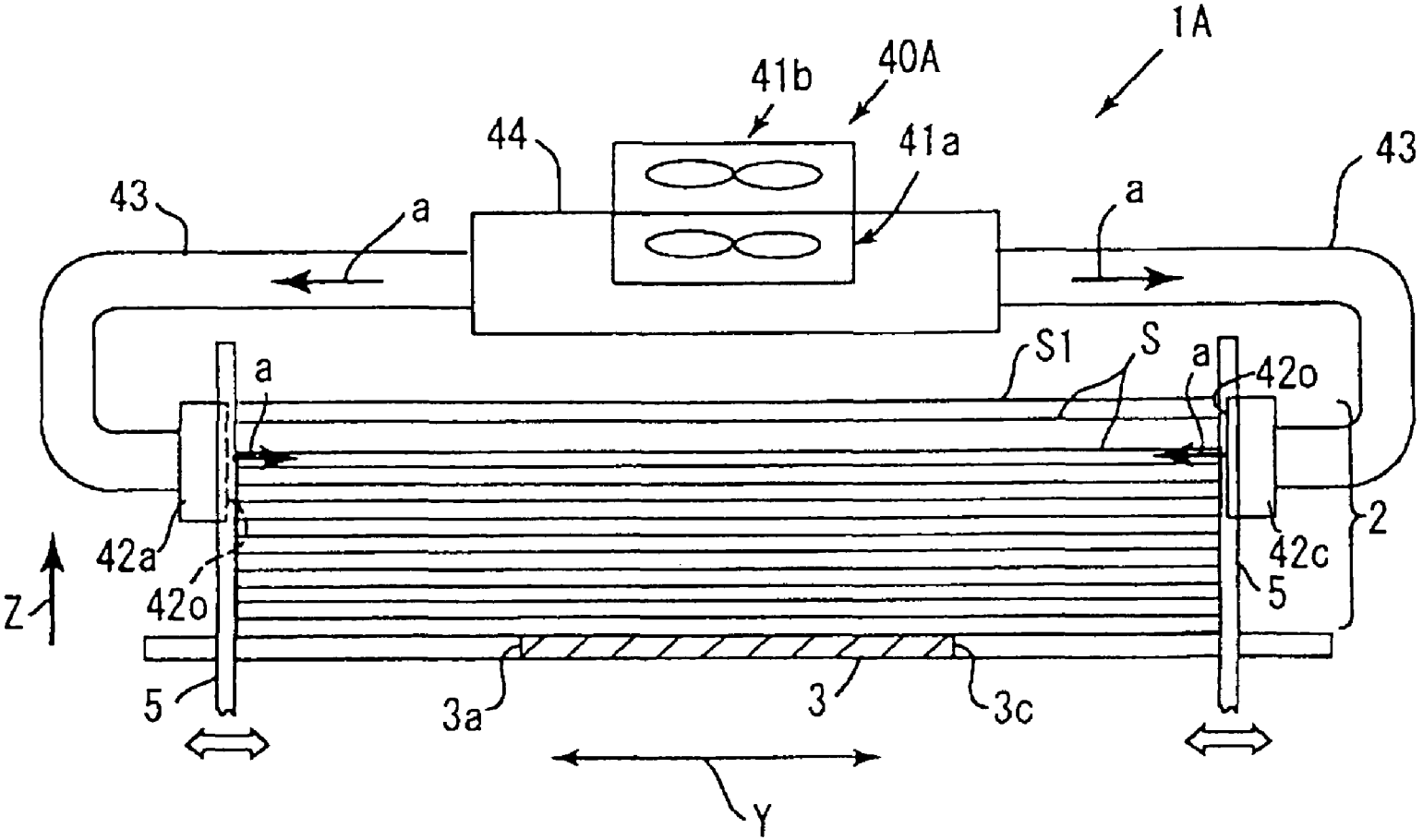
FIG. 4 is a partial schematic side view of the periphery of a side discharge unit of FIG. 1.

As shown in FIGS. 4 and 5, the respective side discharge nozzles 42*a*, 42*b*, 42*c* are fixed to the outer side surfaces of the respective side fences 5, and are linked with and move in the same direction as the movement of the side fence 5 in the sheet width direction Y.

The side discharge nozzle 42*d*, which is disposed in the vicinity of the front face plate 4 (leading edge of the paper stack 2), is not linked to the movement of the side fence 5, and is affixed to the above-mentioned not-shown side plate of the air-type paper feeding device 1. For this reason, the side discharge nozzle 42*d* may also be referred to as the "fixed side discharge nozzle 42*d*" hereinbelow. In other words, the fixed side discharge nozzle 42*d* comprising the most downstream side air outlet 42*o*, which is disposed the furthest downstream of the plurality of side air outlets 42*o* with respect to the sheet feeding direction, is immovably fixed with respect to the sheet feeding direction X and the sheet width direction Y.

The side discharge relay tube 43 is connected such that the side air a force fed from the sirocco fans 41*a*, 41*b*, which are connected in series as described hereinabove, will go to the respective side discharge nozzles 42*a*, 42*b*, 42*c*, 42*d*. The side discharge relay tube 43 is formed from a flexible hose, and in the case of small size paper having a narrow width with respect to the sheet width direction Y, the side discharge relay tube 43 is able to respond without a hitch by bending upwardly when the respective side discharge nozzles 42*a*, 42*b*, 42*c* move in the sheet width direction Y in linkage with the movement of the side fences 5. The respective sirocco fans 41*a*, 41*b* are able to change so as to heighten the static pressure and increase the blowing force by being communicatively connected in series as described hereinabove.

The optimum layout locations of the respective side discharge nozzles 42*a*, 42*b*, 42*c* and the fixed side discharge nozzle 42*d*, which were discovered via the experiment described hereinbelow, for enabling all paper (sheet) sizes and paper (sheet) types utilized in the stencil printing apparatus main unit 150 to be put to good use will be explained by referring to FIG. 5.

The fixed side discharge nozzle 42*d* is disposed in a location in which the side air reliably hits the paper stack 2 in the case of large size paper that is wide with respect to the sheet width direction Y, and in which the air hitting the paper stack 2 becomes weaker in the case of small size paper having a narrow width with respect to the sheet width direction Y, that is, near to the outer side of the paper feeding tray 3 with respect to the sheet width direction Y. The fixed side discharge nozzle 42*d* has the role of reliably lifting the leading edge of a sheet of paper that is wide with respect to the sheet width direction Y like this, and as shown in FIG. 5, is disposed near the outer side of the paper feeding tray 3 with respect to the sheet width direction Y, and in a location that is 20 mm from the front surface plate 4 (or the leading edge of the paper stack loaded and set in the paper feeding tray 3) with respect to the sheet feeding direction X.

To convey a sheet of paper that is narrow with respect to the sheet width direction Y, the side fence 5 and side discharge nozzle 42*a* are disposed in a location that will not interfere with the suctioning unit 10A, that is, in a location that is 85 mm from the front surface plate 4 (or the leading edge of the paper stack loaded and set in the paper feeding tray 3) with respect to the sheet feeding direction X in FIG. 5, and carry out side air blowing at the substantial midpoint of the paper stack. For this reason, it becomes difficult to lift a sheet of paper in the vicinity of the fixed side discharge nozzle 42*d*. Conventionally, also interlockingly moving the side discharge nozzle 42*d* with the side fence 5 would make it possible to respond to various sizes of paper, but in so doing, it would become impossible to separate paper that is smaller in size than the width of the suctioning belt 11 of the suctioning unit 10A with respect to the sheet width direction Y.

The respective side discharge nozzles 42*a*, 42*b*, 42*c*, which are capable of moving in linkage with the side fence 5, and the fixed side discharge nozzle 42*d*, as shown in FIG. 5, are disposed in locations that differ in distance from the front surface plate 4 (or the leading edge of the paper stack loaded and set in the paper feeding tray 3) with respect to the sheet feeding direction X. The distances from the front surface plate 4 to the respective side discharge nozzles 42*a*, 42*b*, 42*c* are set at the above-mentioned 85 mm for side discharge nozzle 42*a*, 310 mm for side discharge nozzle 42*b* and 220 mm for side discharge nozzle 42*c*. These disposition locations prevent the side air from the respective side discharge nozzles 42*a*, 42*b*, 42*c* from colliding with one another when conveying a sheet of paper that is narrow with respect to the sheet width direction Y even when the side discharge nozzles 42*a*, 42*b*, 42*c* move close to the paper, thereby preventing the side air from flowing either in the sheet feeding direction X or the direction opposite thereto. Further, because side air is discharged and blown from both sides facing the respective side edge surfaces of the paper stack, it is also possible to lift all of the sheets of paper.

Next, the paper feeding operation of the paper feeding unit 1A of the air-type paper feeding device 1 will be explained by referring to FIGS. 1 through 9C.

First, the user prepares a paper stack 2 to be used in printing, loads this paper stack 2 onto the paper feeding tray 3, and positions the leading edge of the paper stack 2 by abutting the leading edge surface of the paper stack 2 against the front surface plate 4. Next, after slidingly moving the left and right side fences 5 in the sheet width direction Y to establish the control position that will carry out the positioning of the paper stack 2 with respect to the sheet width direction Y, the side fences 5 are affixed and held in the control position in accordance with suitable locking means. Next, when the user operates the operation panel 90 as described hereinabove, a paper feeding operation commences under the control of not-shown controlling means. First, driving the sirocco fans 41*a*, 41*b* comprising DC fans that are connected in series creates a flow of side air a that has a higher static pressure than a single sirocco fan of the same specifications, this side air a passes through respective side discharge relay tubes 43, 43 on the left and right, also passes through respective side discharge relay tubes 43, 43 that extend in the downstream and upstream sides with respect to the sheet feeding direction X, and is blown onto the respective side edge surfaces of the paper stack 2 from the side air outlets 42*o* of the respective side discharge nozzles 42*a*, 42*b*, 42*c*, 42*d*.

Driving the front air discharge fan 23 at the same time as this creates a flow of air a, this air a passes through the front discharge chamber 20, exits to the outside from the front air outlet 21, and is blown onto the leading edge surface (front edge surface) of the paper stack 2. Blowing the respective air a onto the leading edge surface and both side edge surfaces of the paper stack 2 like this reliably separates the upper portion of the paper stack 2 one sheet at a time as shown in FIGS. 1 and 4.

Next, when the air a is suctioned from the single suctioning chamber 12 in an increased static pressure state via the suctioning drive source chamber 17 and the respective suctioning relay tubes 13, 13 on the right and left by driving the sirocco fans 15*a*, 15*b* comprising serially connected DC fans at a prescribed timing, the inside of the suctioning chamber 12 transitions to negative pressure, and the air a is suctioned from the holes 11*a* of both sides of the suctioning belt 11 within the range opposite the aperture 12*a* of the suctioning chamber 12, thereby reliably adhering and holding by suction to the suctioning belt 11 the uppermost one sheet of separated paper S1 in a state that makes the suctioning area substantially two times that of the prior art suctioning unit 10 explained by referring to FIGS. 15 and 16.

Driving the suctioning belt drive motor 47 when the sheet of paper S1 is adhered to the suctioning belt 11 rotates the drive roller 14*a* in the direction of the arrow in FIG. 1, and the traveling of the suctioning belt 11 conveys the sheet of paper S1 to the resist roller 113*a*, 113*b* on the downstream side with respect to the sheet feeding direction X. In accordance with stopping the driving of the suctioning belt drive motor 47 after the sheet of paper S has been conveyed to the resist rollers 113*a*, 113*b*, the travel of the suctioning belt 11 stops, and waiting-for-suctioning-operation is executed for a prescribed period of time. The conveying of the remainder of the sheet of paper S1 is carried out in accordance with the rotation of the resist rollers 113*a*, 113*b*. When the rear end of the sheet of paper S1 arrives in the vicinity of the front surface plate 4 that is abutting against the leading edge surface of the paper stack 2, the next sheet of separated paper S is adhered to the suctioning belt 11 in accordance with the same operation as described above. Suctioning the air a, which is discharged from air outlet 15*b*2 at this time by driving the sirocco fans 15*a*, 15*b*, via air inlet 41*b*1 in accordance with driving sirocco fans 41*a*, 41*b* improves the suctioning efficiency of sirocco fans 41*a*, 41*b*. The air-type paper feeding continues by repeating the above processes and operations.

In addition to summarizing the effects of this embodiment described hereinabove, the above-mentioned problems associated to the examples of prior art technology will be delved into further at this point. The prior art suctioning relay tube 13 shown in FIGS. 15 and 16:

(a) carries out suctioning from the side of the suctioning belt 11 at one location as shown in FIGS. 15 and 16; and (b) the system is such that paper is suctioned from the upward direction as shown in FIG. 16.

However, in the above-mentioned (a) system, in which suctioning is carried out from the side of the suctioning belt 11 at one location, the size and cross-sectional area of the suctioning relay tube 13 is determined by the suctioning belt 11 pitch interval, that is, the distance between the rollers 14*a*, 14*b* (refer to FIG. 15). That is, based on the relationship shown in FIG. 15, the size and cross-sectional area of the suctioning relay tube 13 is shorter than the suctioning belt pitch interval, and smaller than the diameter of the drive (slave) roller 14*a* (14*b*).

Since there were no space restrictions up to this point, the surface area of the suctioning belt holes<the cross-sectional area of the suctioning relay tube (duct), but when space has to be minimized, that is, when the suctioning belt pitch must be shortened or the diameter of the drive (slave) roller must be made smaller, the cross-sectional area of the suctioning relay tube 13 becomes smaller as a result. That is, the surface area of the suctioning belt holes>the cross-sectional area of the suctioning relay tube (duct), resulting in a decrease in suctioning force.

Increasing the suctioning force when the relationship is such that the surface area of the suctioning belt holes>the cross-sectional area of the suctioning relay tube (duct) has been dealt with by increasing the velocity of the air passing through the suctioning relay tube 13 in accordance with increasing the static pressure of the air suctioning drive fan 15.

However, increasing the static pressure of the air suctioning drive fan 15 is limited in a DC fan, and a large blower, which is driven by an AC (alternating current) motor utilized in an electric vacuum cleaner, has been used. This requires more space for the large blower itself, making it impossible to avoid enlarging the device and raising costs.

Further, viewing the prior art from a different perspective, in a case where the suctioning belt pitch interval has been shortened or the drive (slave) roller diameter made smaller in order to save space and miniaturize the printing apparatus main unit comprising the air-type paper feeding device and the stencil printing apparatus having same, the only configurations devised have been those which connect a single suctioning relay tube (duct) from a single suctioning chamber as in the suctioning unit 10 of the air-type paper feeding device 500 of the prior art shown in FIGS. 15 and 16.

Figure 17:
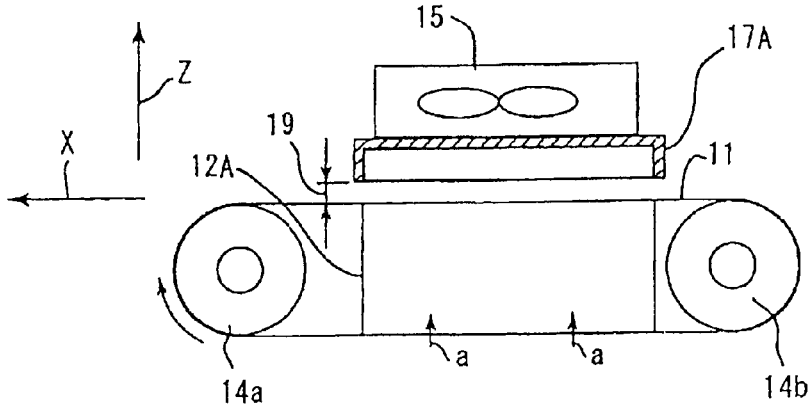
FIG. 17 PRIOR ART
FIG. 17 is a partial cross-sectional front view showing the essential part of the air-type paper feeding device of a different prior art from FIG. 15.

Meanwhile, with regard to (b) mentioned above, an example in which suctioning is performed from the upward direction, which is the paper (sheet) suctioning direction, is shown in FIG. 17. The problem with this system is that the surface area of the suctioning belt holes≅suctioning surface area, and air leaks out and stable suction conveying is not possible as a result of a gap 19 occurring between the suctioning belt 11 of the upper side and the suctioning drive source chamber 17A, and particularly between the suctioning belt 11 of the upper side in the vicinity of the drive roller 14*a* and the suctioning drive source chamber 17A. Furthermore, in FIG. 17, there is a tendency for the suctioning force at suctioning time to cause close contact between the suctioning chamber 12*a* and the upper and lower suctioning belt 11, and between the suctioning drive source chamber 17A and the suctioning belt 11 in the vicinity of the slave roller 14*b*, but this is trifling compared to the gaps 19 in the above-mentioned locations.

Next, the side air blowing force will be considered.

To reliably separate the paper one sheet at a time using the side air, that is, to blow the paper upwards, the faster the side air speed, the more reliable the separation, and the stronger the force per unit area the better.

For example, blowing side air at low speed and a weak force on the entire side edge surface of both sides of the paper, particularly thick paper or enamel paper (designates as coated paper and art paper, and will be referred to generally as "coated paper" hereinafter) under hot, moist paper feeding conditions does not enable highly adhesive coated papers to be separated. Even with a narrow blowing surface area, a faster wind velocity (side air speed) enables reliable separation one sheet at a time. This was confirmed through tests using the air-type paper feeding device 500 configuration shown in FIGS. 15 and 16 in which the side air speed and blowing area were set as parameters, and thick paper and coated paper under high temperature and moisture conditions were separated. Accordingly, the wind velocity should be as fast as possible. Wind velocity has a proportional relationship with the static pressure of the air drive source. The higher the static pressure, the faster the wind velocity becomes.

As explained hereinabove, the following effects are achieved in accordance with this embodiment.

Firstly, equipping the paper feeding unit 1A and the stencil printing apparatus main unit 150 having same with a side discharge unit 40A comprising the characteristic configuration described above makes it possible to reliably separate the sheets of paper S in the upper portion of the paper stack 2 one sheet at a time for all sizes of paper (sheets) used in the stencil printing apparatus main unit 150 using side air a in a state that increases the static pressure via a small number of sirocco fans 41*a*, 41*b* comprising inexpensive DC fans as side air blowing drive sources, thereby enabling stable paper (sheet) conveyance to be carried out without skewing or multi-feeding of sheets. Further, the side air blowing drive source may also dispose the sirocco fans 41*a*, 41*b*, which are communicatively connected in series, in only one location, and there is no need for a stopcock (switching valve). Further, increasing the static pressure as much as possible in accordance with disposing the sirocco fans 41*a*, 41*b* comprising inexpensive DC fans by communicatively connecting these fans in series as described above as the air blowing drive source makes it possible to speed up the side air speed (wind velocity) to reliably separate one sheet at a time thick paper and enamel paper (coated paper) in particular.

Secondly, to achieve space savings and miniaturization in the paper feeding unit 1A and the stencil printing apparatus main unit 150 having same, even in a case where either the suctioning belt 11 pitch interval has been shortened or the diameter of the drive (slave) roller 14*a* (14*b*) has been made smaller, disposing the sirocco fans 15*a*, 15*b* comprising inexpensive DC fans by communicatively connecting these fans in series as described above makes it possible to fully suction, hold and feed the paper S by increasing the static pressure compared to that of the suctioning unit 10 of the prior art example shown in FIGS. 15 and 16.

Thirdly, in accordance with disposing sirocco fan 41*b*, of the sirocco fans 41*a*, 41*b* disposed by being communicatively connected in series, in the vicinity of the air outlet 15*b*2 of sirocco fan 15*b*, the air a discharged by sirocco fan 15*b* is able to be suctioned via air inlet 41*b*1 of sirocco fan 41*b*, thereby making it possible to improve the suctioning efficiency of the sirocco fans 41*a*, 41*b* as the air blowing drive source more than in the case of the suctioning unit 10 of the prior art example shown in FIGS. 15 and 16.

Fourthly, achieving device space saving and miniaturization in accordance with having the suctioning unit 10A of the above-mentioned characteristic configuration may be handled via sirocco fans 15*a*, 15*b* comprising inexpensive DC fans disposed by being communicatively connected in series even in a case where the suctioning belt 11 pitch interval has been shortened or the diameter of the drive or slave roller 14*a*, 14*b* has been made smaller, and since the air a is suctioned through the holes 11*a* of the suctioning belt 11 from the left and right with respect to the sheet width direction Y in accordance with a single suctioning chamber 12 via the suctioning drive source chamber 17 and the respective left and right suctioning relay tubes 13, 13, it is possible to perform feeding by reliably adhering and holding by suction to the suctioning belt 11 the uppermost one sheet of separated paper S1 in a state in which the suctioning surface area relative to the sheet of paper S1 is substantially two times that of the suctioning unit 10 of the prior art example shown in FIGS. 15 and 16. Suctioning the sheet of paper S1 from both sides with respect to the sheet width direction Y enables the sirocco fans 15*a*, 15*b* to be disposed as the air suctioning drive sources in the vicinity above the suctioning belt 11, making it possible to achieve efficiency of space (integration of constituent parts and component members), which is a premise for achieving the fifth effect described below, and being able to shorten the length of the suctioning relay tube (duct) 13 makes it possible to hold down tube friction loss and costs as much as possible.

Fifthly, in accordance with disposing the suctioning belt drive motor 47 for driving the suctioning belt 11 in the vicinity of sirocco fan 15*a*, it becomes possible to bring together the three driving means/drive sources, that is, the sirocco fans 15*a*, 15*b* as the air suctioning drive sources, sirocco fans 41*a*, 41*b* as the air blowing drive sources, and suctioning belt drive motor 47 as driving means in one location, and installing thereover a noise-quieting cover 35 (indicated by the bold dotted line in FIGS. 1 and 2) as a cover member for covering these three driving means/drive sources blocks out and reduces the drive noise, making low noise feeding possible.

The experiments shown in FIGS. 10A through 10C and FIG. 11 were conducted to determine the characteristic configuration employed in the above-described first embodiment, that is, the optimum layout locations for the respective side discharge nozzles 42*a*, 42*b*, 42*c* and the fixed side discharge nozzle 42*d* applicable to all the paper (sheet) sizes and paper (sheet) types used in the stencil printing apparatus main unit 150. All the experiments were conducted on the condition that blowing air a in accordance with the front discharge unit 22 be used in combination with the side air.

Figure 10A:
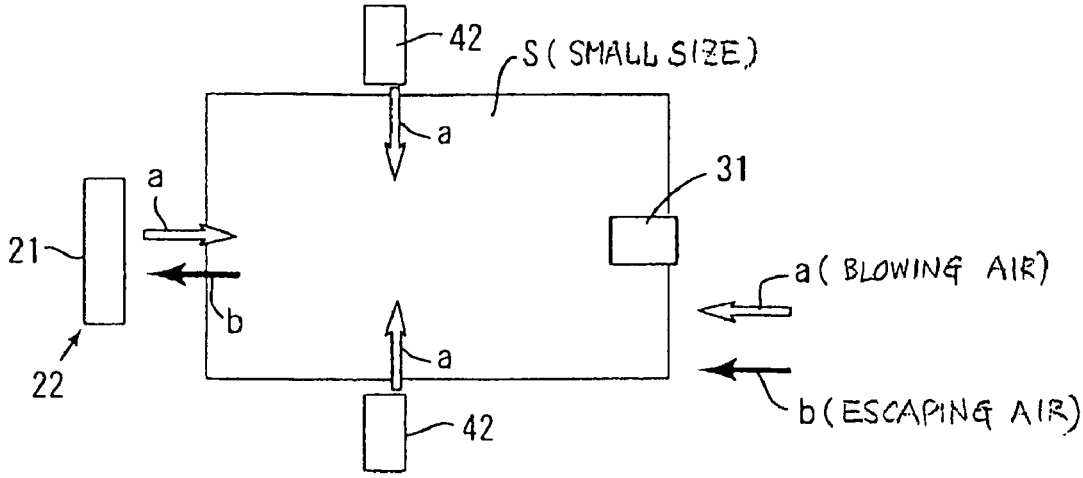
FIG. 10A is a schematic plan view of the essential part illustrating an experiment for determining the optimum layout locations of the respective side discharge nozzles and a fixed side discharge nozzle.
Figure 10B:
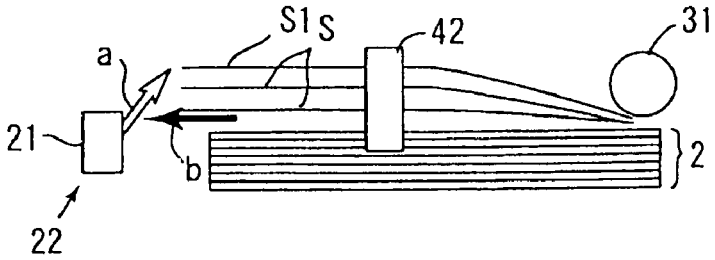
FIG. 10B is a front view thereof.

As described hereinabove, the function of the side air is to reliably lift all of the sheets of paper of the upper portion of the paper stack and separate same one sheet at a time. The more numerous the side air blowing locations, the easier it becomes to lift the sheets of paper, but then again, side effects occur. When air a is blown from both side directions by respective side discharge nozzles 42 facing the respective side edge surfaces of a paper stack 2 of sheets of paper S that are narrow and small with respect to the sheet width direction, for example, A5 or less (a size of 150 mm or less with respect to the sheet width direction) as shown in FIG. 10A, the streams of blown air a collide with one another, the escape route of the escaping air b becomes the forward direction (downstream) with respect to the sheet feeding direction X, sheets of paper S ride and are conveyed on this escaping air b, giving rise to multi-feeding as shown in FIG. 10B.

Figure 10C:
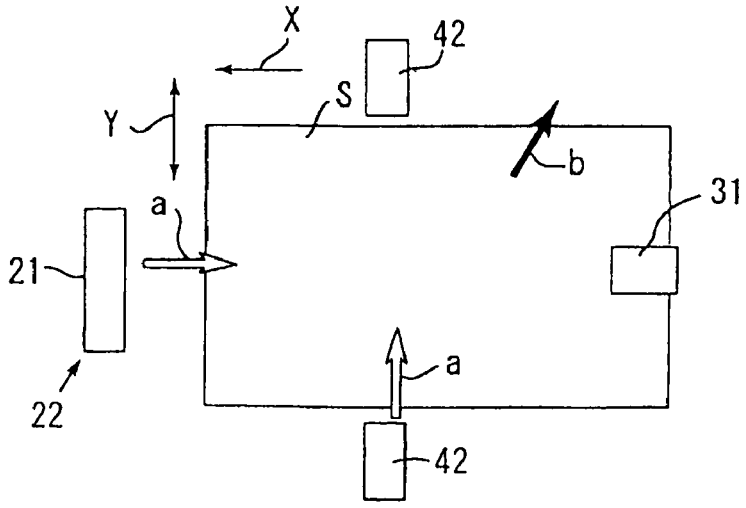
FIG. 10C is a schematic plan view of the essential part illustrating the results of the same experiment.

Accordingly, to secure an escape route for the escaping air b, the side air blowing location was set to one location on the bottom side of the paper as shown in FIG. 10C, and misfeeding stopped occurring.

Furthermore, in FIGS. 10A through 10C, 31 is a driven rotatably supported roller, which is disposed in the vicinity of a not-shown upper limit detection sensor, and which makes contact with the uppermost sheets of paper S of the paper stack 2 on the paper feeding tray (not shown). The up-down operation of the above-mentioned paper feeding tray is controlled such that the uppermost sheets of paper S of the paper stack 2 on the paper feeding tray (not shown) make contact with the roller 31.

Figure 11:
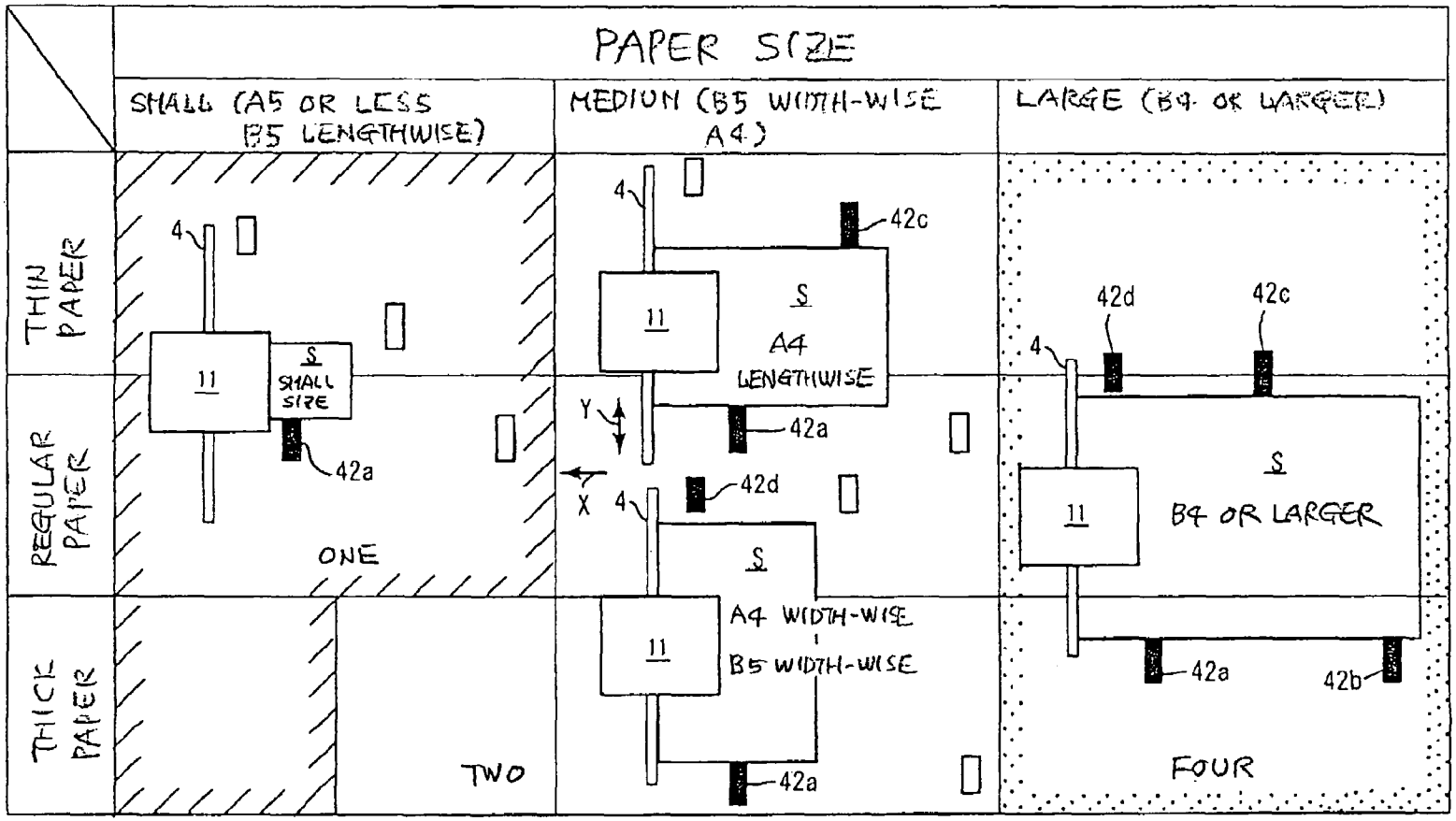
FIG. 11 is a diagram summarizing the optimum layout location states of the side discharge nozzles and fixed side discharge nozzle for all paper sizes and types.

When side air blowing is set to blow and not blow in accordance with small size paper as described above, a side air switching drive source, for example, a switching valve must be added. Accordingly, an experiment was conducted to study side air blowing locations capable of handling all paper sizes and paper types with a side air blowing drive source in one location and no switching valve. FIG. 11 shows the results that were obtained. In FIG. 11, the respective side discharge nozzles 42*a*, 42*b*, 42*c* and the fixed side discharge nozzle 42*d* shown in black represent the optimum number of nozzles and layout locations for each paper size and type. The respective side discharge nozzles 42*a*, 42*b*, 42*c* move in the sheet width direction Y in linkage with the movement of the side fences not shown in FIG. 11.

In summarizing the experimental results of FIG. 11, the optimum layout locations of the respective side discharge nozzles 42*a*, 42*b*, 42*c* and the fixed side discharge nozzle 42*d* comprising side air outlets 42*o* applicable to all the paper sizes and paper types used in the stencil printing apparatus main unit 150 shown in FIG. 5 in working example style as the first embodiment were obtained.

A modification 1 of the first embodiment will be explained by referring to FIGS. 12, 19 and 20.

Figure 12:
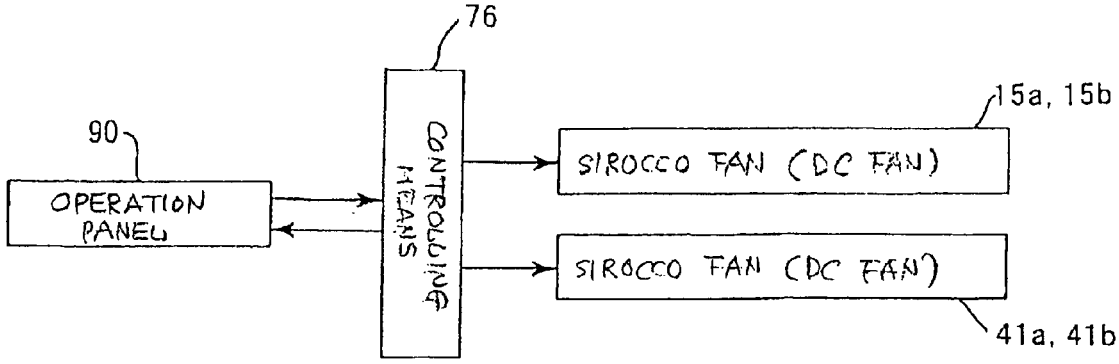
FIG. 12 is a block diagram showing the control configuration of the essential part of a modification 1 of the first embodiment.

Modification 1 mainly differs from the paper feeding unit 1A of the air-type paper feeding device 1 and the stencil printing apparatus main unit 150 having same of the first embodiment in that modification 1 uses a stencil printing apparatus main unit 151 having sheet type setting means as sheet type recognizing means and controlling means 76 provided on the operation panel 90 as shown in FIGS. 12, 19 and 20. Other than the above-mentioned differences, the configuration of modification 1 is the same as that of the first embodiment, and, naturally, has the same paper feeding unit 1A of the air-type paper feeding device 1 as that of the first embodiment.

Sheet type setting means is not limited to the thin paper setting key 131, regular paper setting key 132, coated paper setting key 133 and thick paper setting key 134 disposed on the control panel 90 shown in FIG. 20 for enabling the selection and setting of thin paper, regular paper, coated paper or thick paper, but rather may also be sheet type recognizing means including publicly known sheet type sensing means for recognizing thin paper, regular paper, coated paper and thick paper by sensing the amount of light reflected from the respective surfaces and using the differences in smoothness thereamong. As sheet type sensing means, for example, it is possible to use the same sensing means as the paper type detection sensor (40) shown in FIG. 5 of Japanese Patent Laid-open Publication No. 2001-328332. That is, paper type sensing means is disclosed in paragraph numbers "0059" through "0065" of the above-mentioned publication, and has a light-emitting part (40*a*) comprising a light-emitting element (40*aa*) as light-emitting means for projecting light onto the surface of a sheet of paper (62), and a light-receiving part (40*b*) comprising a plurality of light-receiving elements (40*ba*) as light-receiving means for receiving the reflected light reflected by the surface of this sheet of paper (62), and this light-emitting part (40*a*) and light-receiving part (40*b*) automatically sense the printing medium type by recognizing variations in the received-light locations of the reflected light received by the plurality of light-receiving elements (40*ba*) of the light-receiving part (40*b*) with respect to the sheet of paper (62), which moves in accordance with being conveyed. Further, paper type sensing means may also be means for detecting thin paper, regular paper, coated paper, and thick paper by sensing the amount of transmitted light of a laser light. Sheet type recognizing means comprises both sheet type setting means and sheet type sensing means.

Controlling means 76 has a function for exercising control so as to vary the rotation speeds and air volumes of sirocco fans 15*a*, 15*b* and sirocco fans 41*a*, 41*b* in accordance with any one type of paper (sheet) from the thin paper setting key 131, regular paper setting key 132, coated paper setting key 133 and thick paper setting key 134 selected and set in accordance with sheet type setting means as sheet type recognizing means.

Controlling means 76 comprises a well-known microcomputer comprising a not-shown CPU, ROM, RAM and timer for enabling control of the operation of the liquid crystal display (LCD) and various LEDs, and the above-mentioned devices and parts disposed on the operation panel 90 on the basis of signals from the various keys and switches, and the various sensors disposed on the operation panel 90 (The same holds true for controlling means 77 of modification 2 and controlling means 78 of modification 3 to be explained hereinbelow.). Operation programs and related data for demonstrating the functions of the above-mentioned CPU of controlling means 76 are stored beforehand in the ROM (The same holds true for controlling means 77 of modification 2 and controlling means 78 of modification 3 to be explained hereinbelow.).

As explained in the first embodiment, normally, the respective sirocco fans 15*a*, 15*b* are set to be rotationally driven at the maximum rotation speed, and the respective sirocco fans 41*a*, 41*b* are set to be rotationally driven at 70% of the maximum rotation speed. However, in the case of paper with no elasticity, such as thin paper, there is the danger of the sheet of paper getting wedged into the holes 11*a* of the suctioning belt 11 under high static pressure, thereby damaging the sheet of paper. It is possible to lower the static pressure in this case so as not to damage the thin paper (sheet of paper) by either reducing the rotation speed by one-half or stopping operation of the one fan of the sirocco fans 15*a*, 15*b* in accordance with an instruction from controlling means 76.

As described hereinabove, normally the respective sirocco fans 41*a*, 41*b* are set to be rotationally driven at 70% of the maximum rotation speed. However, in a case where a sheet of paper with no elasticity, such as thin paper, is used, a fast side air speed (wind velocity) will blow upwards more sheets of paper S on the paper stack 2 of thin paper than needed, causing the sheets of paper S to flap around, making it difficult for the suctioning belt 11 of the suctioning unit 10A side to suction the uppermost sheet of paper S1, leading to misfeeding.

In this case, either the rotation speed of both of the sirocco fans 41*a*, 41*b* will be automatically slowed down (for example, the fan voltage will be set to 14V) or the one of the sirocco fans 41*a*, 41*b* will be stopped in accordance with an instruction from controlling means 76.

Further, in a case where thick paper is used, the side air speed (wind velocity) should be speeded up in order to reliably separate the sheets of paper S on top of the paper stack 2 of thick paper one sheet at a time. In this case, the rotation speed of both sirocco fans 41*a*, 41*b* will be automatically speeded up (a fan voltage of around 21V) in accordance with an instruction from controlling means 76.

In other words, according to modification 1, the same effects as the first embodiment are achieved, of course, and when using thin paper, it is possible to lower the static pressure so as not to damage the thin paper (sheet of paper) by either reducing the rotation speed by one-half or stopping operation of the one fan of the sirocco fans 15*a*, 15*b*, and it is also possible to slow down the side air speed (wind velocity) by either automatically slowing down the rotation speed of both of the sirocco fans 41*a*, 41*b* (for example, a fan voltage of 14V) or stopping the one of the sirocco fans 41*a*, 41*b* in accordance with control by controlling means 76 by pressing the thin paper setting key 131 for setting the thin paper mode on the operation panel 90. Further, when using thick paper, it is possible to automatically speed up (a fan voltage of around 21V) the rotation speed of both sirocco fans 41*a*, 41*b* in accordance with control by controlling means 76 by pressing the thick paper setting key 134 on the operation panel 90.

In modification 1, an example was explained in which controlling means 76 and sheet type recognizing means are disposed in the stencil printing apparatus main unit 151 side, but the present invention is not limited to this, and the configuration may also be such that controlling means 76 and sheet type recognizing means are disposed in the paper feeding unit 1A side of the air type paper feeding device 1 serving as the sheet feeding device.

A modification 2 of the first embodiment will be explained by referring to FIGS. 13 and 19.

Figure 13:
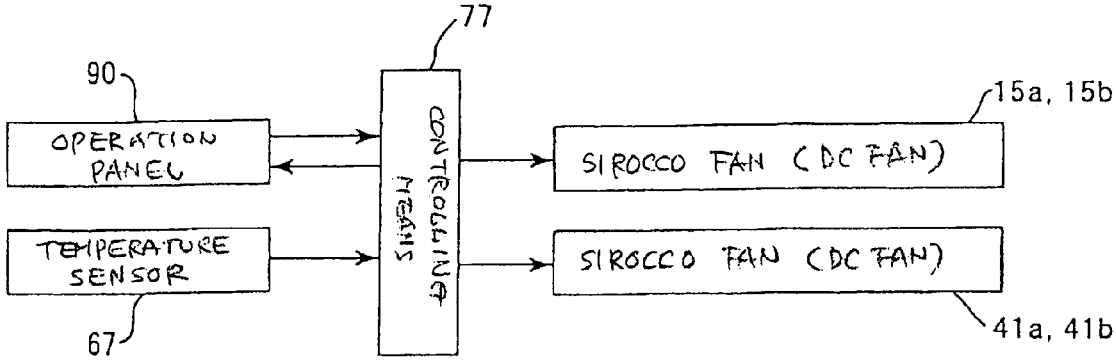
FIG. 13 is a block diagram showing the control configuration of the essential part of a modification 2 of the first embodiment.

Modification 2 differs from the paper feeding unit 1A of the air-type paper feeding device 1 and the stencil printing apparatus main unit 150 having same of the first embodiment mainly in that modification 2 uses a stencil printing apparatus main unit 152 having sheet type setting means as sheet type recognizing means provided on the operation panel 90, a temperature sensor 67 comprising, for example, a thermistor disposed on the inside of the apparatus main unit, and controlling means 77 as shown in FIGS. 13, 19 and 20. Other than the above-mentioned points of difference, the configuration of modification 2 is the same as that of the first embodiment, and, naturally, has the same paper feeding unit 1A of the air-type paper feeding device 1 as the first embodiment.

Controlling means 77 has a function for exercising control so as to change the rotation speed and air volume of sirocco fans 15*a*, 15*b* and sirocco fans 41*a*, 41*b* in accordance with any one sheet type from the thin paper setting key 131, regular paper setting key 132, coated paper setting key 133 and thick paper setting key 134 selected and set in accordance with sheet type setting means as sheet type recognizing means, and the temperature inside the device main unit 50 detected in accordance with the temperature sensor 67.

When the temperature and humidity are high, there is increased danger of damaging thin paper and other such sheets of paper, and in the case of thick paper such as enamel paper (coated paper), the sheets of coated paper stick fast to one another under high-temperature, high-humidity conditions, making it difficult to separate this coated paper one sheet at a time. Accordingly, modification 2 achieves not only the same effects as the first embodiment, but also other effects in addition to the characteristic control in modification 1 in accordance with controlling means 76. Specifically, in modification 2, the thin paper mode is set by pressing the thin paper setting key 131 for setting the thin mode when using thin paper, and in a case where temperature from the temperature sensor 67 is higher than the temperature stored beforehand in a not-shown ROM, it is also possible to automatically stop the operation of the one fan in accordance with control by controlling means 77, thereby suitably lowering the static pressure in accordance with only the other fan so as not to damage the thin paper (sheet of paper).

Further, when using thick enamel paper (coated paper), the thick paper mode is set by pressing the thick paper key 134 and the enamel paper (coated paper) mode is set by pressing the coated paper setting key 133, and when the temperature from the temperature sensor 67 is higher than the temperature stored beforehand in the not-shown ROM (for example, 27° C.), it is possible, either at the same time as the above-mentioned control or independently thereof, to maximize the side air speed (wind velocity) by automatically maximizing (a rated voltage of 24V) the rotation speed of both sirocco fans 41*a*, 41*b* in accordance with control by controlling means 77, thereby enabling these sheets of paper S to be reliably separated one sheet at a time even when using thick enamel paper (coated paper) when the temperature and humidity are high.

Furthermore, in a case where more accurately detecting a high-temperature, high-humidity state is desired, it is preferable to use a publicly known temperature-humidity sensor that integrates a temperature sensor and a humidity sensor as temperature-humidity detecting means.

In modification 2, an example was explained in which controlling means 77, sheet type recognizing means and a temperature sensor 67 as temperature detecting means are disposed in the stencil printing apparatus main unit 152 side, but the present invention is not limited to this, and the configuration may also be such that controlling means 77, sheet type recognizing means and the temperature sensor 67 as temperature detecting means are disposed in the paper feeding unit 1A of the air-type paper feeding device 1 serving as the sheet feeding device.

A modification 3 of the first embodiment will be explained by referring to FIGS. 14, 19 and 20.

Figure 14:
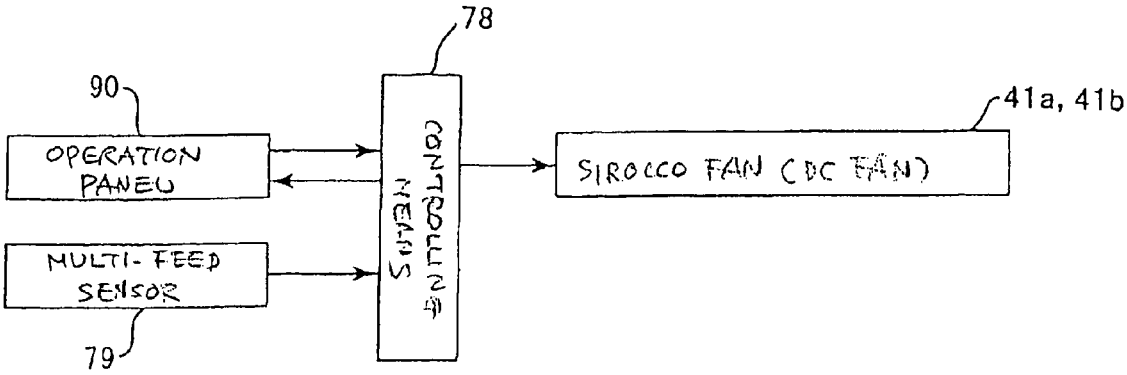
FIG. 14 is a block diagram showing the control configuration of the essential part of a modification 3 of the first embodiment.

Modification 3 differs from the paper feeding unit 1A of the air-type paper feeding device 1 and the stencil printing apparatus main unit 150 having same of the first embodiment mainly in that modification 3, as shown in FIGS. 14, 19 and 20, uses a stencil printing apparatus main unit 153 having a multi-feed sensor 79 as multi-feed recognizing means/multi-feed detecting means for recognizing multi-feeding of the sheets of paper S, and controlling means 78. Other than the above-mentioned points of difference, the configuration of modification 3 is the same as that of the first embodiment, and, naturally, has the same paper feeding unit 1A of the air-type paper feeding device 1 as the first embodiment.

Controlling means 78 has a function for exercising control so as to change the rotation speed and air volume of the respective sirocco fans 41*a*, 41*b* in accordance with the multi-feeding of the sheets of paper S detected by the multi-feed sensor 79. The multi-feed sensor 79 of this embodiment is disposed over the paper (sheet) conveying route between the outlet for the sheet of paper conveyed from the paper feeding unit 1A and the pair of resist rollers 113*a*, 113*b*.

The multi-feed sensor 79, for example, may include the example, which is disclosed in FIG. 1 and paragraph "0012" of Japanese Patent Laid-open Publication No. 7-121079, and which uses multi-feed sensor (7) configured from a photodiode to detect multi-feeding from changes in the transmittance of the paper. Further, the multi-feed sensor (10) that uses an ultrasound sensor disclosed in FIG. 2 and paragraph "0023" of Japanese Patent Laid-open Publication No. 2000-159393, or a publicly known sensor that uses an optical sensor may also be used.

In addition to multi-feed detecting means for automatically detecting multi-feeding, multi-feed recognizing means also include multi-feed setting means for making a setting when multi-feeding occurs.

In a case where the multi-feeding of sheets of paper S has been detected by the multi-feed sensor 79, the side air speed (wind velocity) is automatically increased by raising the voltage of the sirocco fans 41*a*, 41*b* currently in operation by around 2V in accordance with an instruction from controlling means 78 to increase the rotation speed of the sirocco fans 41*a*, 41*b*, thereby making it possible to reliably separate the sheets of paper S one at a time in the paper feeding and separating operations subsequent to clearing the paper jam.

This is not possible when the respective sirocco fans 41*a*, 41*b* are operating at the maximum voltage of 24V, but when multi-feeding occurs at a voltage other than 24V, a multi-feed warning is displayed on the LCD screen of the touch panel 98 on the operation panel 90 and/or a warning notice is issued by sounding the buzzer 97 in accordance with an instruction from controlling means 78 so that the user knows that multi-feeding has occurred by virtue of the above-mentioned warning display and/or warning sound and is able to deal with this problem the same as described above by pressing a not-shown multi-feed mode key or multi-feed mode button that serves as multi-feed setting means, which is suitably disposed on the touch panel 98 of the operation panel 90.

The present invention is not limited to the example described above, and when multi-feeding occurs two, three or more times in a row, it is also possible to automatically increase the side air speed (wind velocity) by increasing the voltage of the sirocco fans 41*a*, 41*b* currently operating, thereby increasing the rotation speed of the sirocco fans 41*a*, 41*b*.

In modification 3, an example in which controlling means 78 is disposed on the stencil printing apparatus main unit 153 side is explained, but the present invention is not limited to this, and the configuration may also be such that controlling means 78 and the multi-feed sensor 79 as multi-feed recognizing means/multi-feed detecting means is disposed in the paper feeding unit 1A of the air-type paper feeding device 1 serving as the sheet feeding device.

The present invention is not limited to a printing apparatus, such as a stencil printer (stencil printing apparatus) or offset printer, and as a matter of course may also be applied to image-forming apparatuses such as digital photo copiers, printers, inkjet recording apparatuses, or compound apparatuses configured from a plurality thereof. When the present invention is applied to an image-forming apparatus, "printing apparatus" may be read as "image-forming apparatus", and "printing image forming means" may be read as "image forming means".

According to the present invention, it is possible to realize and provide a novel sheet feeding device and the image-forming apparatus having same that makes it possible to resolve the above-mentioned problems and achieve the above-mentioned object. The main effects of the present invention are as follows:

(1) It is possible to reliably separate the sheets from a sheet stack one sheet at a time for all sheet sizes and sheet types utilized in an image-forming apparatus using a small number of side air blowing drive sources (for example, drive sources that communicatively connect a plurality of sirocco fans comprising inexpensive DC fans in series), thereby enabling stable sheet feeding to be carried out without skewing or multi-feeding. Further, there is no need for a switching valve drive source.

(2) The intake efficiency of the side air blowing drive source may be improved by enabling the side air blowing drive source to intake the air discharged from the air outlet of the air suctioning drive source.

(3) Communicatively connecting in series and disposing a plurality of sirocco fans as side air blowing drive sources comprising inexpensive DC fans makes it possible to raise the static pressure, speed up the side air speed (wind velocity) and, in particular, reliably separate even thick paper and enamel paper (coated paper) one sheet at a time.

(4) Communicatively connecting in series and disposing a plurality of sirocco fans as air suctioning drive sources comprising inexpensive DC fans makes it possible to sufficiently suction, hold and feed sheets by raising the static pressure.

(5) By disposing driving means for driving the belt in the vicinity of air suctioning means and having a cover member for covering the side air blowing drive sources, air suctioning drive sources and driving means, the respective driving noises are blocked out and reduced in accordance with the cover member, thereby making low noise feeding possible.

(6) Having the sheet feeding device disclosed in any one of Claims 1 through 11 makes it possible to realize and provide an image-forming apparatus that achieves the effects of the present invention.

As explained hereinabove, the present invention has been explained with respect to a specific embodiment, experiments and modifications, but the technological scope disclosed in the present invention is not limited to the examples given in the above-described embodiment and modifications, or working examples, and a person skilled in the art could clearly configure a suitable combination therefrom, and could configure a variety of embodiments and modifications or working examples according to the need and utilization therefor without departing from the scope of the present invention.

For example, a control configuration that suitably combines the modifications 1 through 3 explained hereinabove may be used, and, based on the contents disclosed in the present application, a person skilled in the art will easily be able to understand and work the invention so as to configure a control configuration capable of carrying out the control of all of modifications 1 through 3.

What is claimed is:

1. A sheet feeding apparatus comprising:

air-type separating means for separating a sheet one at a time by blowing air on both side edge surfaces of a loaded sheet stack;

air suctioning means for suctioning an uppermost separated sheet;

a pair of side fences, which control a location of both side edges of the sheet stack with respect to a sheet width direction that is orthogonal to a sheet feeding direction, and which are configured to move in the sheet width direction; and sheet feeding means for feeding the sheet held by suction by the air suctioning means in the sheet feeding direction, wherein the air-type separating means has a plurality of side air outlets via which air is blown onto the respective side edge surfaces of the sheet stack, and a side air blowing drive source which is communicatively connected to the plurality of side air outlets, and the plurality of side air outlets are disposed in at least two locations opposite the respective side edge surfaces of the sheet stack, and the side air outlets are each disposed at different distances from the leading edge of the sheet stack with respect to the sheet feeding direction such that no two side air outlets are at a same distance from the leading edge of the sheet stack with respect to the sheet feeding direction, and one side air outlet being attached to each side fence and moving with the side fence.

2. The sheet feeding device according to claim 1, wherein, of the plurality of side air outlets, the furthest downstream side air outlet disposed the furthest downstream with respect to the sheet feeding direction is immovably fixed with respect to the sheet feeding direction and the sheet width direction.

3. The sheet feeding device according to claim 1, wherein the side air blowing drive source comprises an air inlet for suctioning air, and an air outlet which is communicatively connected to the side air outlets and discharges air, the air suctioning means has an air suctioning drive source comprising an air inlet for suctioning air and an air outlet for discharging air, and the side air blowing drive source is disposed in the vicinity of the air outlet of the air suctioning drive source.

4. The sheet feeding device according to claim 3, wherein the air suctioning drive source is a sirocco fan, the sirocco fan is provided in plurality, and an air outlet of an upstream side the fan is disposed by being communicatively connected to an air inlet of a downstream side sirocco fan adjacent to the upstream side sirocco fan.

5. The sheet feeding device according to claim 3, wherein the air suctioning means comprises a belt which is suspended between a pair of rotating members and travels in the sheet feeding direction in order to suction and convey the uppermost separated sheet, driving means for driving the belt is disposed in the vicinity of the air suctioning drive source, and a cover member for covering the side air blowing drive source, the air suctioning drive source and the driving means.

6. The sheet feeding device according to claim 1, wherein the side air blowing drive source is a sirocco fan, the sirocco fan is provided in plurality, and an air outlet of an upstream side sirocco fan is disposed by being communicatively connected to an air inlet of a downstream side sirocco fan adjacent to the upstream side sirocco fan.

7. The sheet feeding device according to claim 6, wherein the respective sirocco fans comprise DC fans capable of changing the static pressure and air volume by varying rotation speed.

8. The sheet feeding device according to claim 7, further comprising sheet type recognizing means for recognizing a type of sheet; and controlling means for controlling the respective sirocco fans in accordance with the type of sheet recognized by the sheet type recognizing means.

9. The sheet feeding device according to claim 7, further comprising sheet type recognizing means for recognizing a type of sheet; temperature detecting means for detecting the temperature of the sheet feeding device; and controlling means for controlling the respective sirocco fans in accordance with the type of sheet recognized by the sheet type recognizing means and the temperature of the sheet feeding device detected by the temperature detecting means.

10. The sheet feeding device according to claim 7, further comprising multi-feed detecting means for detecting the multi-feeding of sheets; and controlling means for controlling the respective sirocco fans serving as the side air blowing drive sources based on the multi-feeding of sheets detected by the multi-feed detecting means.

11. An image-forming apparatus comprising a sheet feeding device and image forming means for forming an image on a fed sheet, the sheet feeding apparatus comprising:

air-type separating means for separating a sheet one at a time by blowing air on both side edge surfaces of a loaded sheet stack;

air suctioning means for suctioning an uppermost separated sheet;

a pair of side fences, which control a location of both side edges of the sheet stack with respect to a sheet width direction that is orthogonal to a sheet feeding direction, and which are configured to move in the sheet width direction; and sheet feeding means for feeding the sheet held by suction by the air suctioning means in the sheet feeding direction, the air-type separating means having a plurality of side air outlets via which air is blown onto the respective side edge surfaces of the sheet stack, and a side air blowing drive source which is communicatively connected to the plurality of side air outlets, and the plurality of side air outlets being disposed in at least two locations opposite the respective side edge surfaces of the sheet stack, and the side air outlets each being disposed at different distances from the leading edge of the sheet stack with respect to the sheet feeding direction such that no two side air outlets are at a same distance from the leading edge of the sheet stack with respect to the sheet feeding direction, and one side air outlet being attached to each side fence and moving with the side fence.

12. A sheet feeding apparatus comprising:

an air-type separating unit configured to separate a sheet one at a time by blowing air on both side edge surfaces of a loaded sheet stack;

an air suctioning unit configured to suction an uppermost separated sheet;

a pair of side fences, which control a location of both side edges of the sheet stack with respect to a sheet width direction that is orthogonal to a sheet feeding direction, and which are configured to move in the sheet width direction; and a sheet feeding unit configured to heat the sheet held by suction by the air suctioning unit in the sheet feeding direction, wherein the air-type separating unit has a plurality of side air outlets via which air is blown onto the respective side edge surfaces of the sheet stack, and a side air blowing drive source which is communicatively connected to the plurality of side air outlets, and the plurality of side air outlets are disposed in at least two locations opposite the respective side edge surfaces of the sheet stack, and the side air outlets are each disposed at different distances from the leading edge of the sheet stack with respect to the sheet feeding direction such that no two side air outlets are at a same distance from the leading edge of the sheet stack with respect to the sheet feeding direction, and one side air outlet being attached to each side fence and moving with the side fence.

13. The sheet feeding device according to claim 12, wherein, of the plurality of side air outlets, the furthest downstream side air outlet disposed the furthest downstream with respect to the sheet feeding direction is immovably fixed with respect to the sheet feeding direction and the sheet width direction.

14. The sheet feeding device according to claim 12, wherein the side air blowing drive source comprises an air inlet for suctioning air, and an air outlet which is communicatively connected to the side air outlets and discharges air, the air suctioning unit has an air suctioning drive source comprising an air inlet for suctioning air and an air outlet for discharging air, and the side air blowing drive source is disposed in the vicinity of the air outlet of the air suctioning drive source.

15. The sheet feeding device according to claim 14, wherein the air suctioning drive source is a sirocco fan, the sirocco fan is provided in plurality, and an air outlet of an upstream side sirocco fan is disposed by being communicatively connected to an air inlet of a downstream side sirocco fan adjacent to the upstream side sirocco fan.

16. The sheet feeding device according to claim 14, wherein the air suctioning unit includes a belt which is suspended between a pair of rotating members and travels in the sheet feeding direction in order to suction and convey the uppermost separated sheet, a driving unit configured to drive the belt is disposed in the vicinity of the air suctioning drive source, and a cover member configured to cover the side air blowing drive source, the air suctioning drive source and the driving unit.

17. The sheet feeding device according to claim 12, wherein the side air blowing drive source is a sirocco fan, the sirocco fan is provided in plurality, and an air outlet of an upstream side sirocco fan is disposed by being communicatively connected to an air inlet of a downstream side sirocco fan adjacent to the upstream side sirocco fan.

18. The sheet feeding device according to claim 17, wherein the respective sirocco fans comprise DC fans capable of changing the static pressure and air volume by varying rotation speed.

* * * * *